US005275916A

United States Patent [19]

Kato

[11] Patent Number: 5,275,916

[45] Date of Patent: Jan. 4, 1994

[54] DIRECT-IMAGE TYPE LITHOGRAPHIC PRINTING PLATE PRECURSOR

[75] Inventor: Eiichi Kato, Shizuoka, Japan

[73] Assignee: Fuji Photo Film Co., Ltd., Kanagawa, Japan

[21] Appl. No.: 869,953

[22] Filed: Apr. 17, 1992

[30] Foreign Application Priority Data

Apr. 19, 1991 [JP] Japan ..... 3-87126
Jun. 10, 1991 [JP] Japan ..... 3-137786

[51] Int. Cl.[5] ..... G03C 1/725

[52] U.S. Cl. ..... 430/286; 430/281; 430/287; 430/302

[58] Field of Search ..... 430/281, 286, 287, 302

[56] References Cited

U.S. PATENT DOCUMENTS 4,617,239 10/1986 Maruyama et al. ..... 428/452

FOREIGN PATENT DOCUMENTS 0076490 4/1983 European Pat. Off. .
894186 4/1962 United Kingdom .

OTHER PUBLICATIONS

World Patents Index Latest Week 9009, Derwent Publications Ltd., London, GB; AN 90-062891 & Patent Abstracts of Japan vol. 14, No. 158 (P-1027) Mar. 27, 1990 & JPA-2 015280 (Fuji Photo Film Co. Ltd) Jan. 18, 1990.

World Patents Index Latest Week 9009, Derwent Publications Ltd., London, GB; AN 90-062890 & Patent Abstract of Japan vol. 14, No. 158 (P-1027) Mar. 27, 1990 & JPA-2 015279 (Fuji Photo Film Co. Ltd) Jan. 18, 1990.

World Patents Index Latest Week 9009, Derwent Publications Ltd., London, GB; AN 90-062889 & Patent Abstracts of Japan vol. 14, No. 158 (P-1027) Mar. 27, 1990 & JPA-2 015278 (Fuji Photo Film Co. Ltd) Jan. 18, 1990.

Patent Abstracts of Japan, vol. 12, No. 190 (M-704)(3037) Jun. 3, 1988 & JPA-62-197 186 (Ricoh Co. Ltd) Dec. 24, 1987.

*Primary Examiner*—John Kight, III
*Assistant Examiner*—T. Mosley
*Attorney, Agent, or Firm*—Sughrue, Mion, Zinn, Macpeak & Seas

[57] ABSTRACT

A direct image type lithographic printing plate precursor according to this invention has an image-receiving layer on a support, said image-receiving layer containing at least one of nonaqueous type dispersed resin particles which are copolymer resin particles obtained by dispersion copolymerization of a monofunctional monomer A and a monofunctional monomer B in a nonaqueous solvent in the presence of a dispersion-stabilizing resin soluble in said nonaqueous solvent, said monofunctional monomer A containing at least one functional group which forms at least one hydrophilic group selected from a carboxyl group, a thiol group, a phosphono group, an amino group and a sulfo group upon decomposition, said monomer being soluble in said nonaqueous solvent but made insoluble therein upon polymerization, and said monofunctional monomer B containing a silicon and/or fluorine atom-containing substituent and being copolymerizable with said monofunctional monomer A.

11 Claims, No Drawings

DIRECT-IMAGE TYPE LITHOGRAPHIC PRINTING PLATE PRECURSOR

BACKGROUND OF THE INVENTION

The present invention relates to a lithographic printing plate precursor and, more particularly, to a direct-image type lithographic printing plate precursor which is suitably used to make printing plates for office work purposes.

Now, a direct-image type lithographic printing plate precursors having an image-receiving layer on a support have been widely used to make printing plates for office work purposes. For making printing plates with such precursors or in order to form images on them, the images are handwritten on them with oil ink or formed on them as by typewriters, ink-jet printing or transfer type thermal printing. Recently, there is also available a technique in which a toner image is formed on a photosensitive material through the steps of charging, exposure and development carried out using a plain paper electrophotographic copy machine (PPC) and then transferred and fixed onto an image-receiving layer. In order to enable this precursor to be used as a printing plate for lithography, in any case, it should be treated on its surface with a desensitizing (or etching) solution to desensitize the non-image area.

The conventional direct-image type lithographic printing plate precursor has comprised a support made up of a paper sheet, on both sides of which a back layer and a front layer are applied, the latter being provided through an interlayer. The back layer or interlayer is made f a water-soluble resin such as PVA starch, a water-dispersible resin such as a synthetic resin emulsion and a pigment. The front layer is made up of a pigment, a water-soluble resin and a waterproofing agent.

As typically set forth in U.S. Pat. No. 2,532,865 specification, such a direct-image type lithographic printing plate precursor has an image-receiving layer composed mainly of a water-soluble resin binder such as PVA, an inorganic pigment such as silica or calcium carbonate and a waterproofing agent such an initial melamine-formaldehyde condensate.

Further, the binder used for the image-receiving layer of the direct-image type lithographic printing plate precursor is pre-crosslinked, containing a functional group capable of forming a carboxyl group, a hydroxyl or thiol group, an amino group, a sulfone group and a phosphono group upon decomposition and a functional group set by heat/light (Japanese Patent Application Nos. 63-54609 and 63-117035 and Japanese Provisional Publication No. 1-269593). It is also proposed to use the binder in combination with thermosetting/photosetting resins (see Japanese Provisional Patent Publication Nos. 1-266546 and 1-275191 as well as Japanese Patent Application No. 63-139344) or in combination with crosslinkers (see Japanese Provisional Patent Publication Nos. 1-267093, 1-271292 and 1-309067), thereby improving on not only the hydrophilic nature of the non-image area and the film strength of the image-receving layer but also plate wear as well.

However, a problem with the printing plate precursors so obtained is that when an increased quantity of a waterproofing agent, or a hydrophobic resin, is used to enhance their hydrophobic nature for the purpose of increasing their printing serviceability, there is an increase in their plate wear but there is a decrease in their hydrophilic nature, which would otherise result in scumming, whereas improving on their hydrophilic nature makes them poor in water resistance and plate wear. A particularly grave problem with them is that when they are used at a high temperature exceeding 30° C., their surface layers are dissolved in the dampening water used for offset printing, giving rise to a drop of plate wear and scumming.

Another problem with the lithographic printing plate precursors, on the image-receiving layers or image areas of which images are formed with oil ink, is that if the receiving layers do not show well adhesion to oil ink, then the oil ink peels away from the image areas during printing, resulting in a drop of plate wear. This is true even when the non-image areas have hydrophilic nature enough to prevent scumming.

The present invention has been achieved with a view to eliminating the above problems with a conventional direct-image type of lithographic printing plate precursors.

One object of this invention is to provide a direct-image type lithographic printing plate precursor which can be well desensitized and so can be used as an offset printing plate precursor free from not only overall uniform scumming but a spot-form of scumming as well.

Another object of this invention is to provide a lithographic printing plate precursor in which oil ink on the image area has an improved adhesion to the image-receiving layer and the hydrophilic nature of the non-image area is well retained even after printing is repeated over and over, and which has a high plate wear and does not give rise to scumming.

SUMMARY OF THE INVENTION

According to this invention, the above-described and other objects are achieved by the provision of a direct-image type lithographic printing plate precursor having an image-receiving layer on a support, wherein said image-receiving layer contains at least one of nonaqueous solvent type dispersed resin particles which are copolymer resin particles obtained by dispersion copolymerization of a monofunctional monomer A and a monofunctional monomer B in a nonaqueous solvent in the presence of a dispersion-stabilizing resin soluble in said nonaqueous solvent, said monofunctional monomer A containing at least one hydrophilic group selected from a carboxyl group, a thiol group, a phosphono group, an amino group and a sulfo group upon decomposition, said monomer being soluble in said nonaqueous solvent but made insoluble therein upon polymerization, and said monofunctional monomer B containing a silicon and/or fluorine atom-containing substituent and being copolymerizable with said monofunctional monomer A.

Preferably, the aforesaid nonaqueous solvent type dispersed resin particles have a high-order network structure.

Preferably, the aforesaid dispersion-stabilizing resin has in its polymer chain at least one polymerizable double bond moiety represented by the following general formula (1):

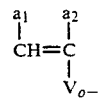

(1)

where:

$V_0$ represents —O—, —COO—, —OCO—,

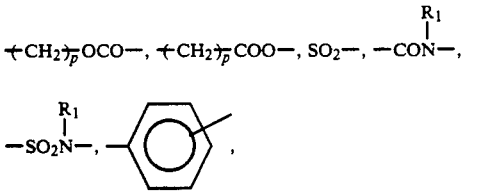

—CONHCOO— or —CONHCONH— (wherein p represents an integer of 1-4 and $R_1$ represents a hydrogen atom or a hydrocarbon group having 1-18 carbon atoms), and $a_1$ and $a_2$, which may be the same or different, each represent a hydrogen atom, a halogen atom, a cyano group, a hydrocarbon group —COO—$R_2$ or —COO—$R_2$ through a hydrocarbon group (wherein $R_2$ represents a hydrogen atom or a hydrocarbon group).

Thus, this invention provides a printing plate precursor provided with an image-receiving layer, which can be used as an offset printing plate by making the non-image area of said image-receiving layer hydrophilic by desensitization.

Of importance in this invention is that the resin particles—which contain at least one functional group forming at least one carboxyl group upon decomposition and which are at least partly crosslinked together—be dispersed throughout the surface layer separately from the binder resin that is the matrix of said surface layer and in the form of discrete particles, and that said resin particles contain at least a fluorine atom and/or a silicon atom.

Thus, the lithographic printing plate precursor of this invention is advantageous over the prior art in that it enables an original image to be faithfully reproduced; it does not give rise to scumming because of the hydrophilic nature of its non-image area being much improved; and its plate wear is much improved because of the hydrophilic nature of its non-image area being well maintained.

Of importance for a lithographic printing plate precursor is that its non-image area be made hydrophilic well enough on the surface. By contrast, the above-mentioned known type resin—which forms a hydrophilic group by a decomposition reaction—is dispersed uniformly throughout the surface layer. Consequently, in order to make the surface of the surface layer hydrophilic well enough for printing with the aforesaid known resin, the hydrophilic group-forming functional group must be allowed to be ominipresent throughout the surface layer and in large quantities.

According to this invention, however, the resin particles are allowed to be concentrated on the surface portion of the surface layer of the image-receiving layer, because they contain a copolymer component containing at least one fluorine and/silicon atoms. This enables the particles of this invention present on the surface portions to produce hydrophilic groups by such a desensitization treatment as a hydrolysis, redox, decomposition or photodecomposition reaction, thus enabling the hydrophilic nature of the surface layer to be effectively exhibited. At the same time, this effect is further enhanced by the water retention of the particles themselves. Furthermore, when the particles have a cross-linked structure, their water retention is much more enhanced due to their water absorptivity.

On the other hand, the particles of this invention have an effect on preventing the liberation of particles made hydrophilic by desensitization, because they are so bonded to the lipophilic dispersion-stabilizing resin that they can act mutually on the binder resin phase of the surface layer.

DESCRIPTION OF THE PREFERRED EMBODIMENT

The resin particles dispersed throughout the image-receiving layer according to this invention will now be explained more specifically. First, detailed reference will be made to the functional group of the resin particle which is decomposed to form at least one carboxyl group—which may hereinafter be simply referred to as the carboxyl group-forming functional group.

The carboxyl group-forming functional group forms a carboxyl group upon decomposition, but one or two or more carboxyl groups may be formed from one such a functional group.

According to one preferred embodiment of this invention, the resin containing the carboxyl group-forming functional group has at least one functional group represented by the following general formula (2):

$$-COO-L_1. \quad (2)$$

Here $L_1$ represents

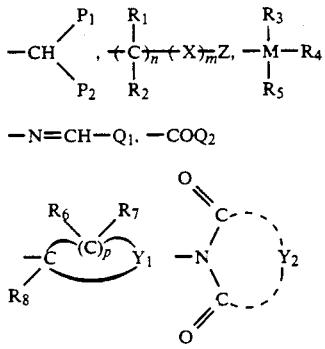

The functional group represented by Formula (2), which forms a carboxyl group upon decomposition, will now be explained more specifically.

When $L_1$ is

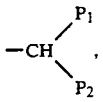

$P_1$ respresents a hydiogen atom or a group —CN, —$CF_3$, —$COR_{11}$ or —$COOR_{11}$. Here $R_{11}$ represents an alkyl group having 1-6 carbon atoms such as a methyl, ethyl, propyl, butyl, pentyl or hexyl group; a $C_{7-12}$ aralkyl group which may have a substituent such as a benzyl, phenethyl, chlorobenzyl, methoxybenzyl, chlorophenethyl or methylphenethyl group; or an aromatic group exemplified by a phenyl or naphthyl group which may have a substituent, for instance, a phenyl, chlorophenyl, dichlorophenyl, methylphenyl, methoxyphenyl, acetylphenyl, acetamidophenyl, metoxycarbonyl-phenyl or naphthyl group.

$P_2$ stands for a group —CN, —$COR_{11}$ or —$COOR_{11}$. Here $R_{11}$ has the same meanings as defined just above.

$L_1$ is

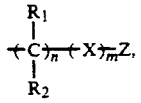

it is preferred tht $R_1$ and $R_2$, identical with or different from each other, each represent a hydrogen atom or a $C_{1-12}$ straight-chain or branched alkyl group which may have a substituent (for instantce, a methyl, ethyl, propyl, chloromethyl, dichloromethyl, trichloromethyl, trifluoromethyl, butyl, hexyl, octyl, decyl, hydroxyethyl or 3-chloropropyl group; X represents a phenyl or naphthyl group which may have a substituent (for instance, a phenyl, methylphenyl, chlorophenyl, dimethylphenyl, chloromethylphenyl or naphthyl group); Z indicates a hydrogen atom, a halogen atom (e.g., a chlorine or fluorine atom), a trihalomethyl group (e.g., a trichloromethyl group), a $C_{1-12}$ straight-chain or branched alkyl group which may have a substituent (e.g., a methyl, chloromethyl, dichloromethyl, ethyl, propyl, butyl, hexyl, tetrafluoroethyl, octyl, cyanoethyl or chloroethyl group), a —CN group, a —$CN_2$ group, a —$SO_2R_1'$ group wherein $R_1'$ is an aliphatic group (e.g., a $C_{1-12}$ alkyl group which may have a substituent such as a methyl, ethyl, propyl, butyl, chloroethyl, pentyl or octyl group or a $C_{7-12}$ aralkyl group which may have a substituent such as a benzyl, phenethyl, chlorobenzyl, methoxybenzyl, chlorophenethyl or methylphenethyl group) or an aromatic group (e.g., a phenyl or naphthyl group which may have a substituent such as a phenyl, chlorophenyl, dichlorophenyl, methylphenyl, methoxyphenyl, acetylphenyl, acetamidophenyl, methoxycarbonylphenyl or naphthyl group), a —$COOR_2'$ group wherein $R_2'$ has the same meanings as defined for $R_1'$, or a —O—$R_3'$ group wherein $R_3'$ has the same meanings as defined in connection with $R_1'$; and n and m each denotes an integer of 0, 1 or 2.

When $L_1$ is

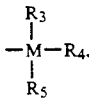

it is preferred that $R_3$, $R_4$ and $R_5$, which may be identical with or different from each other, each represent a $C_{1-18}$ aliphatic group which may have a substituent (e.g., an alkyl, alkenyl, aralkyl or alicyclic group which has such a substituent as a halogen atom or a —CN, —OH or —O—Q' group wherein Q' stands for an alkyl, aralkyl, alicyclic or aryl group), a $C_{6-18}$ aromatic group which may have a substituent (e.g., a phenyl, tolyl, chlorophenyl, methoxyphenyl, acetamidophenyl or naphthyl group) or a —O—$R_4'$ group wherein $R_4'$ denotes a $C_{1-12}$ alkyl group which may have a substituent, a $C_{2-12}$ alkenyl group which may have a substituent, a $C_{7-12}$ aralkyl group which may have a substituent, a $C_{5-18}$ alicyclic group which may have a substituent or a $C_{6-18}$ aryl group which may have a substituent; and M denotes an Si, Ti or Sn atom, preferably an Si atom.

When $L_1$ is —N=CH—$Q_1$ or —CO—$Q_2$, $Q_1$ and $Q_2$ each stand for a $C_{1-18}$ aliphatic group which may have a substituent (e.g., an alkyl, alkenyl, aralkyl or alicyclic group having such a substituent as a halogen atom, a CN group or an alkoxy group) or a $C_{6-18}$ aryl group which may have a substituent (e.g., a phenyl, methoxyphenyl, tolyl, chlorophenyl or naphthyl group).

When $L_1$ is

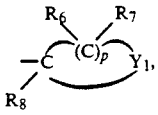

it is preferred that $Y_1$ stands for an oxygen or sulfur atom; $R_6$, $R_7$ and $R_8$, which may be identical with or different from each other, each indicate a hydrogen atom, a $C_{1-18}$ straight-chain or branched alkyl group which may have a substituent (e.g., a methyl, ethyl, propyl, butyl, hexyl, octyl, decyl, dodecyl, octadecyl, chloroethyl, methoxyethyl or methoxypropyl group), an alicyclic group which may have a substituent (e.g., a cyclopentyl or cyclohexyl group), a $C_{7-12}$ aralkyl group which may have a substituent (e.g., a benzyl, phenethyl, chlorobenzyl or methoxybenzyl group), an aromatic group which may have a substituent (e.g., a phenyl, naphthyl, chlorophenyl, tolyl, methoxyphenyl, methoxycarbonylphenyl or dichlorophenyl group) or a —O—$R_5'$ group wherein $R_5'$ denotes a hydrocarbon group or, more specifically, the same substituent as those on the above hydrocarbon groups $R_6$, $R_7$ and $R_8$; and p represents an integer of 3 or 4.

When $L_1$ is

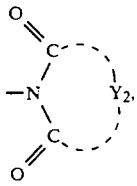

$Y_2$ represents an organic residue which forms a cyclic imido group, preferably that having the following general formula (3) or (4):

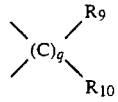

(3)

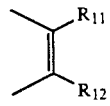

(4)

In the general formula (3), $R_9$ and $R_{10}$, which may be identical with or different from each other, each represent a hydrogen atom, a halogen atom (e.g., a chlorine or fluorine atom), a $C_{1-18}$ alkyl group which may have a substituent [e.g., a methyl, ethyl, propyl, butyl, hexyl, octyl, decyl, dodecyl, hexadecyl, octadecyl, 2-chloroethyl, 2-methoxyethyl, 2-cyanoethyl, 3-chloropropyl, 2-(methanesylfonyl)-ethyl or 2-(ethoxyoxy)-ethyl], a $C_{7-12}$ aralkyl group which may have a substituent (e.g., a benzyl, phenethyl, 3-phenylpropyl, methylbenzyl, dimethylbenzyl, methoxybenzyl, chlorobenzyl or bromobenzyl group), a $C_{3-18}$ alkenyl group which may have a substituent (e.g., an allyl, 3-methyl-2-propenyl, 2-hexenyl, 4-propyl-2-pentenyl or 12-octadecenyl group), a —S—$R_6'$ group wherein $R_6'$ has the same meanings as defined in connection with the alkyl, aralkyl and alkenyl groups for the above $R_9$ and $R_{10}$, an aryl group which may have a substituent (e.g., a phenyl, tolyl, chlorophenyl, bromophenyl, methoxyphenyl, ethoxyphenyl or ethoxycarbonylphenyl group), or a —$NHR_7'$ group wherein $R_7'$ has the same meanings as defined for the above $R_6'$, or $R_9$ and $R_{10}$ may represent together a ring-forming residue (e.g., a five- or six-membered monocyclic residue represented by a cyclopentyl or cyclohexyl residue or a five- or six-membered bicyclic residue represented by a bicycloheptane, bicycloheptyne, bicyclooctane or bicyclooctene residue, which may all have the same substituent as mentioned in regard to $R_9$ and $R_{10}$; and q denotes an integer of 2 or 3.

In the general formula (4), $R_{11}$ and $R_{12}$, which may be identical with or different from each other, have the same meanings as defined in regard to the above-defined $R_9$ and $R_{10}$. Alternatively, $R_{11}$ and $R_{12}$ may be bonded together to form an organic residue forming an aromatic ring such as a benzene or naphthalene ring.

According to another preferable embodiment of this invention, the resin contains at least one functional group represented by the following general formula (5):

$$-CO-L_2. \quad (5)$$

In the general formula (5), $L_2$ represents:

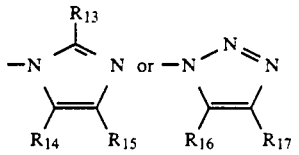

Here $R_{13}$, $R_{14}$, $R_{15}$, $R_{16}$ and $R_{17}$ each represent a hydrogen atom or an aliphatic group.

Preferable to the aliphatic group are those referred to in regard to the above $R_6$, $R_7$ and $R_8$. Alternatively, $R_{14}$ and $R_{15}$ or $R_{16}$ and $R_{17}$ may represent together an organic residue which forms a condensed ring. Preferably, mentioned are a five-or six-membered monocyclic residue (e.g., a cyclopentyl or cyclohexyl residue) and a five- to twelve-membered aromatic residue (e.g., a benzene, naphthalene, thiophene, pyrrole, pyran or quinoline residue).

According to a further preferable embodiment of this invention, the carboxyl group-forming functional group contains at least one oxazolone ring having the following general formula (6):

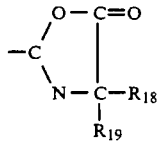

(6)

In the general formula (6), $R_{18}$ and $R_{19}$, which may be identical with or different from each other, each represent a hydrogen atom or a hydrocarbon group. Alternatively, $R_{18}$ and $R_{19}$ may form together a ring.

It is preferable that $R_{18}$ and $R_{19}$, which may be identical with or different from each other, each represent a hydrogen atom, a $C_{1-12}$ straight-chain or branched alkyl group which may have a substituent (e.g., a methyl, ethyl, propyl, butyl, hexyl, 2-chloroethyl, 2-methoxyethyl, 2-methoxycarbonylethyl or 3-hydroxypropyl group), a $C_{7-12}$ aralkyl group which may have a substituent (e.g., a benzyl, 4-chlorobenzyl, 4-acetamidobenzyl, phenethyl or 4-methoxylbenzyl group), a $C_{2-12}$ alkenyl group which may have a substituent (e.g., an ethylene, allyl, isopropenyl, butenyl or hexenyl group), a five- to seven-membered alicyclic group which may have a substituent (e.g., a cyclopentyl, cyclohexyl or chlorocyclohexyl group) or an aromatic group which may have a substituent (e.g., a phenyl, chlorophenyl, methoxyphenyl, acetamidophenyl, methylphenyl, dichlorophenyl, nitrophenyl, naphthyl, butylphenyl or dimethylphenyl group). Alternatively, $R_{18}$ and $R_{19}$ may form together a ring (e.g., tetramethylene, pentamethylene or hexamethylene).

Set out below are specific, but not exclusive, examples of the functional groups having the general formulae (2)–(6).

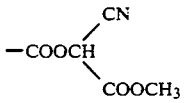

(a-1)

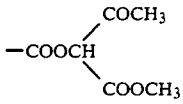

(a-2)

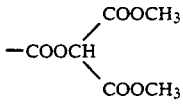

(a-3)

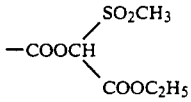

(a-4)

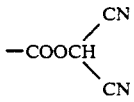

(a-5)

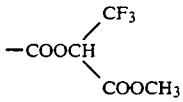

(a-6)

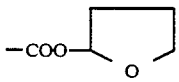

(a-7)

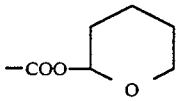

(a-8)

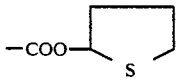

(a-9)

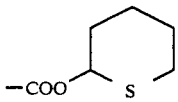

(a-10)

-continued
(a-11)
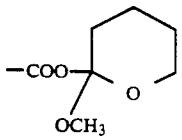
(a-12)
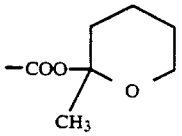
(a-13)
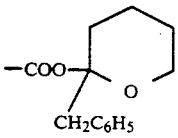
(a-14)
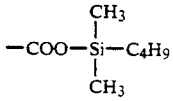
(a-15)
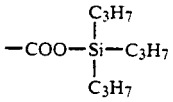
(a-16)
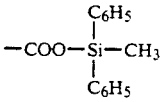
(a-17)
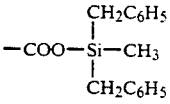
(a-18)
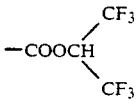
(a-19)
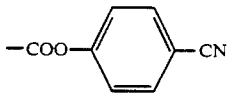
(a-20)
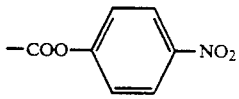
(a-21)
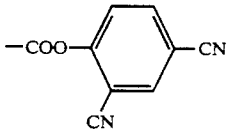
(a-22)
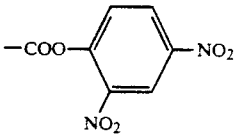
-continued
(a-23)
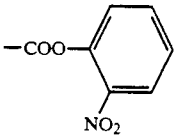
(a-24)
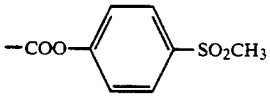
(a-25)
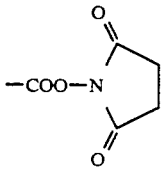
(a-26)
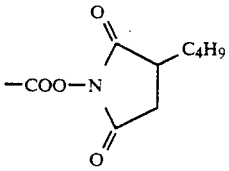
(a-27)
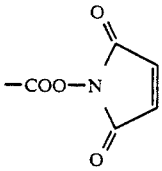
(a-28)
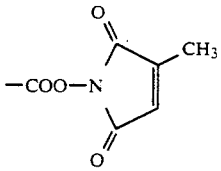
(a-29)
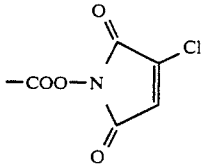
(a-30)
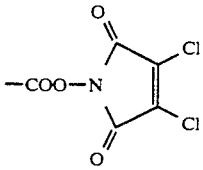
(a-31)
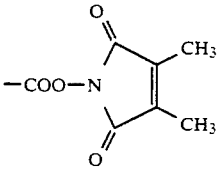

-continued (a-32)

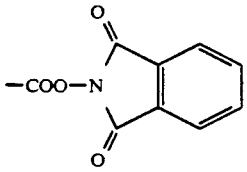

(a-33)

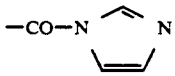

(a-34)

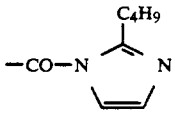

(a-35)

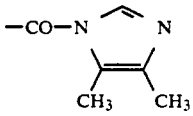

(a-36)

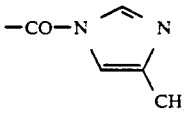

(a-37)

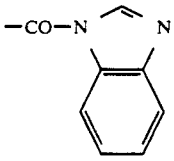

(a-38)

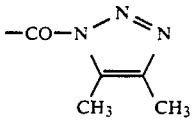

(a-39)

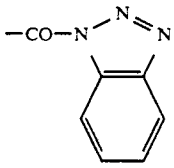

(a-40)

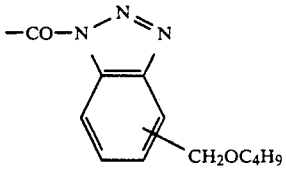

(a-41)

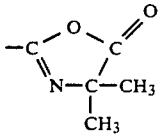

(a-42)

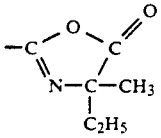

-continued (a-43)

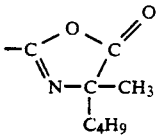

(a-44)

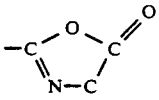

(a-45)

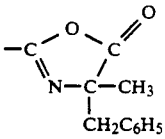

(a-46) $-COOCH_2OCH_3$ (a-47)

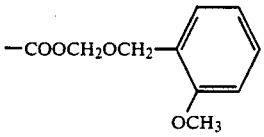

(a-48) $-COOCH(C_6H_5)_2$ (a-49) $-COOC(C_6H_5)_3$ (a-50)

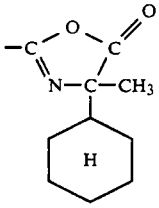

Specific, but not exclusive, exmaples of the monomer (A) containing the functional groups having the formulae (2)-(6) are expressed by the following general formula (7):

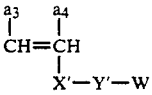

(7)

wherein:

X' stands for a group —O—, —C00, —C00—, —OCO—,

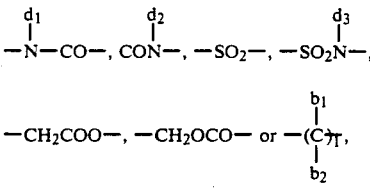

an aromatic or heterocyclic group, provided that $d_1$, $d_2$, $d_3$ and $d_4$ each represent a hydrogen atom, a hydrocarbon group or the group —[Y'—W] in Formula (7) and $b_1$ and $b_2$, which may be identical with or different from each other, each represent a hydrogen atom, a hydrocarbon group or the —[Y'—W] in Formula (7) and l denotes an integer of 0–18;

Y' represents a carbon-carbon bond for bonding the bonding group X' to the functional group W, which may have between them such a heteroatom as a oxygen, sulfur or nitrogen atom, for instance, bonding units

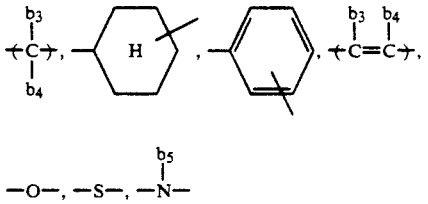

—COO—, —CONH—, —$SO_2$—, —$SO_2NH$— and —NHCONH— wherein $b_3$, $b_4$ and $b_5$ have the same meanings as defined for the above-described $b_1$ and $b_2$, which may be used alone or in combination;

W represents a functional group having any one of Formulae (2)–(6); and $a_3$ and $a_4$ have the same meanings as defined in connection with $a_1$ and $a_2$ in Formula (1) to be described later.

Reference will now be made to the functional group used in this invention, which is decomposed to form at least one hydrophilic group such as thiol, phosphono, sulfo and amino groups. This functional group may hereinafter be simply referred to as the hydrophilic group-forming functional group.

In the ensuing description, the functional group which is decomposed to form at least one thiol group-the thiol group-forming functional group-will be explained more specifically.

According to one preferred embodiment of this invention, the thiol group-forming functional group is represented by the following general formula (7'):

$$[-S-L^A], \qquad (7')$$

wherein:

$L^A$ stands for

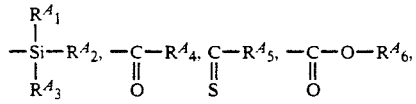

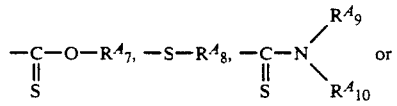

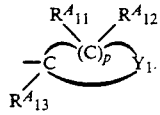

Here $R^A{}_1$, $R^A{}_2$ and $R^A{}_3$, which may be identical with or different from each other, each represent a hydrocarbon group or a group —O—$R^{A'}$ where $R^{A'}$ represents a hydrocarbon group; $R^A{}_4$, $R^A{}_5$, $R^A{}_6$, $R^A{}_7$, $R^A{}_8$, $R^A{}_9$ and $R^A{}_{10}$ each represent a hydrocarbon group; and $R^A{}_{11}$, $R^A{}_{12}$ and $R^A{}_{13}$ each independently represent a hydrogen atom or a hydrocarbon group.

When $L^A$ denotes

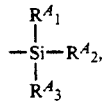

$R^A{}_1$, $R^A{}_2$ and $R^A{}_3$, which may be identical with or different from each other, should each preferably denote a $C_{1-18}$ straight-chain or branched alkyl group which may have a substituent (e.g., a methyl, ethyl, propyl, butyl, hexyl, octyl, decyl, dodecyl, octadecyl, chloroethyl, methoxyethyl or methoxypropyl group), an alicylic group which may have a substituent (e.g., a cyclopentyl or cyclohexyl group), a $C_{7-12}$ aralkyl group which may have a substituent (e.g., a benzyl, phenethyl, chlorobenzyl or methoxybenzyl group), an aromatic group which may have a substituent (e.g., a phenyl, naphthyl, chlorophenyl, tolyl, methoxyphenyl, methoxycarbonylphenyl or dichlorophenyl group) or a group —O—$R^{A'}$ where $R^{A'}$ stands for a hydrocarbon group and may specifically be the substituents of the hydrocarbon groups of the above-described $R^A{}_1$, $R^A{}_2$ and $R^A{}_3$.

When $L^A$ represents

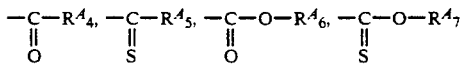

or —S—$R^A{}_8$, it is preferred that $R^A{}_4$, $R^A{}_5$, $R^A{}_6$, $R^A{}_7$ and $R^A{}_8$ each denote a $C_{1-12}$ straight-chain or branched alkyl group which may have a substituent (e.g., a methyl, trichloromethyl, trifluoromethyl, methoxymethyl, ethyl, propyl, n-butyl, hexyl, 3-chloropropyl, phenoxymethyl, 2,2,2-trifluoroethyl, t-butyl, hexafluoroisopropyl, octyl or decyl group), a $C_{7-9}$ aralkyl group which may have a substituent (e.g., a benzyl, phenethyl, methylbenzyl, trimethylbezyl, heptamethylbenzyl or methoxybenzyl group) or a $C_{6-12}$ aryl group which may have a substituent (e.g., a phenyl, nitrophenyl, cyanophenyl, methanesulfonylphenyl, methoxyphenyl, butoxyphenyl, chlorophenyl, dichlorophenyl or trifluoromethylphenyl group).

When $L^A$ denotes

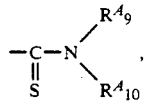

$R^A{}_9$ and $R^A{}_{10}$ may be identical with or different from each other and should each preferably be the substituent that is described as preferable for the above-mentioned $R^A{}_4$ and $R^A{}_5$.

When $L^A$ denotes

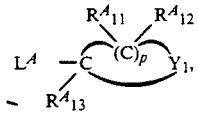

$Y_1$ stands for an oxygen or sulfur atom; $R^A{}_{11}$, $R^A{}_{12}$ and $R^A{}_{13}$ may be identical with or different from each other and should each preferably represent a hydrogen atom or a $C_{1-12}$ straight-chain or branched alkyl group which may have a substituent or more preferably have the same meanings as mentioned in connection with the above-described $R^A_4$–$R^A_8$; and p indicates an integer of 3 or 4.

Another preferable thiol group-forming functional group according to this invention contains a thiirane ring having the following general formula (8) or (9):

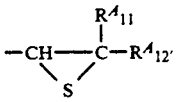

(8)

or

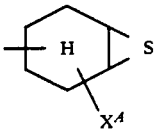

(9)

In Formula (8), $R^A_{11}$ and $R^A_{12}$, which may be identical with or different from each other, each represent a hydrogen atom or a hydrocarbon group, preferably, a hydrogen atom or the substituent that is described as preferable for the abovementioned $R^A_4$–$R^A_7$.

In Formula (9), $X^A$ stands for a hydrogen atom or an aliphatic group that is preferably an alkyl group having 1-6 carbon atoms, e.g., a methyl, ethyl, propyl or butyl group.

A further preferable thiol group-containing functional group according to this invention contains a sulfur-containing heteroring group having the following general formula (10):

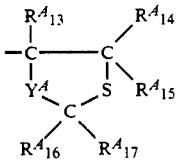

(10)

Here $Y^A$ represents an oxygen atom or a —HN— group; and $R^A_{13}$, $R^A_{14}$ and $R^A_{15}$, which may be identical with or different from each other, each represent a hydrogen atom or a hydrocarbon group, preferably, a hydrogen atom or the substituent described as preferable for the above-mentioned $R^A_4$–$R^A_7$ and $R^A_{16}$ and $R^A_{17}$, which may again be identical with or different from each other, each represent a hydrogen atom, a hydrocarbon group or —O—$R^{A''}$ where $R^{A''}$ is a hydrocarbon group, preferably, the substituent that is described as preferable for the above-mentioned $R^A_1$–$R^A_3$.

According to a further preferable aspect of this invention, the thiol group-forming functional group contains at least one functional group in which at least two tiol groups located sterically close to each other are simultaneously protected with a single protective group.

For instance, the functional group—in which at least two tiol groups located sterically close to each other are simultaneously protected with a single protective group—is expressed by the following general formulae (11), (12) and

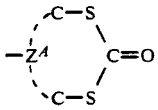

(11)

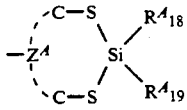

(12)

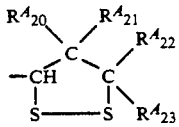

(13)

In Formulae (11) and (12), $Z^A$ stands for a chemical bond for bonding carbon-carbon or C—S bonds directly together, which may have a heteroatom between them, provided that the inter-sulfur atom number is 4 at most. Alternatively, one ($Z^A$. . . C) bond may represent a single mere bond, as expressed as follows:

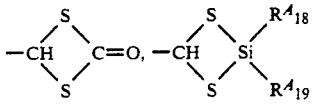

In Formula (12), $R^A_{18}$ and $R^A_{19}$, which may be identical with or different from each other, each denote a hydrogen atom, a hydrocarbon group or a group —O—$R^{A''}$ where $R^{A''}$ is a hydrocarbon group).

In Formula (12), it is preferred that $R^A_{18}$ and $R^A_{19}$, which may be identical with or different from each other, each denote a hydrogen atom, a $C_{1-12}$ alkyl group which may have a substituent (e.g., a methyl, ethyl, propyl, butyl, hexyl, 2-methoxyethyl or octyl group), a $C_{7-9}$ aralkyl group which may have a substituent (e.g., a benzyl, phenethyl, methylbenzyl, methoxylbenzyl or chlorobenzyl group), a $C_{5-7}$ alicyclic group (e.g., a cyclopentyl or cylcohexyl group), an aryl group which may have a substituent (e.g., a phenyl, chlorophenyl, methoxyphenyl, methylphenyl or cyanophenyl group) or a group —O—$R^{A''}$ where $R^{A''}$ has the same meanings as defined in connection with $R^A_{18}$ and $R^A_{19}$.

In Formula (13), $R^A_{20}$, $R^A_{21}$, $R^A_{22}$ and $R^A_{23}$ may be identical with or different from each other, and each denote a hydrogen atom or a hydrocarbon group. Preferably, each of them denotes a hydrogen atom or the hydrocarbon group described as preferrable for the above-mentioned $R^A_{18}$ and $R^A_{19}$.

The monomer [A] used in this invention and containing at least one of the functional groups having the above-described general formulae (7)–(13) may be prepared by various methods including those described in:

Yoshio IWAKURA and Keisuke KURITA, "Reactive High-Polymers", pp. 230–237 (published by Kodansha Ltd. in 1977), "Shin Jikken Kagaku Koza" edited by the Japan Chemical Society, Vol. 14-"Synthesis and Reactions of Organic Compounds [III]", Chapter 8, pp. 1700–1713 (published by Maruzen Co., Ltd. in 1978), J. F. W. McOmie, "Protective Groups in Organic Chemistry", Chapter 7 (published by Plenum Press. in 1973), and S. Patai, "The Chemistry of the thiol group, Part 2", Chapters 12 and 14 (published by John Wiley & Sons in 1974).
More specifically but not exclusively, the monomers containing the functional groups having the above-described general formulae (7)-(13) include the following compounds:
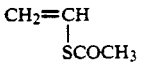
(1)
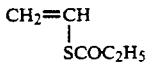
(2)
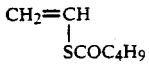
(3)
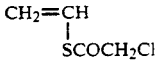
(4)
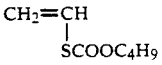
(5)
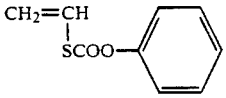
(6)
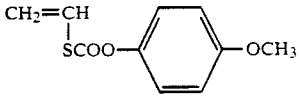
(7)
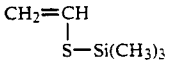
(8)
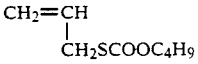
(9)
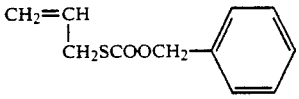
(10)
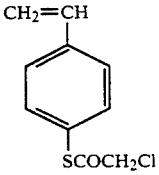
(11)
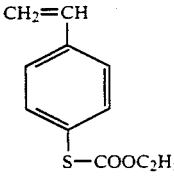
(12)
-continued
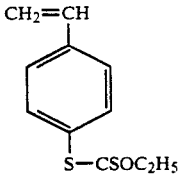
(13)
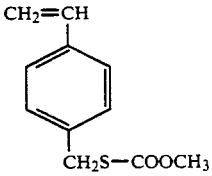
(14)
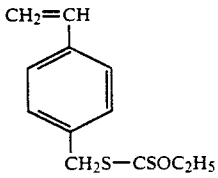
(15)
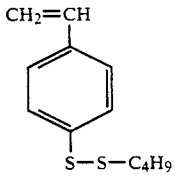
(16)
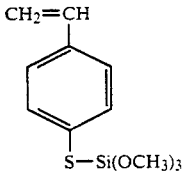
(17)
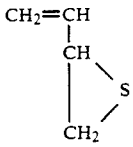
(18)
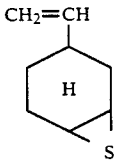
(19)
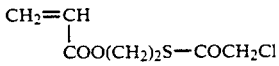
(20)
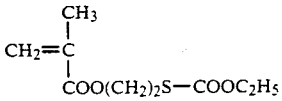
(21)
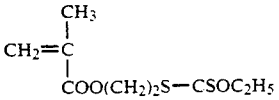
(22)

-continued
(23)
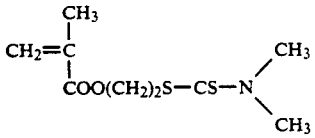
(24)
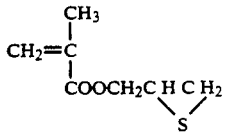
(25)
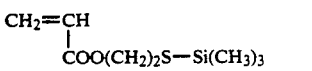
(26)
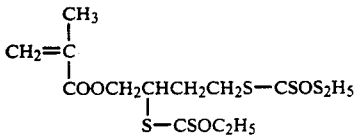
(27)
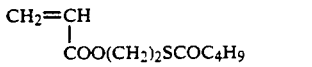
(28)
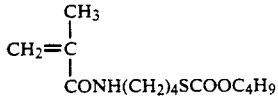
(29)
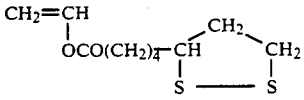
(30)
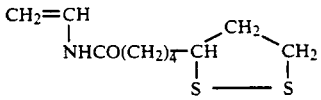
(31)
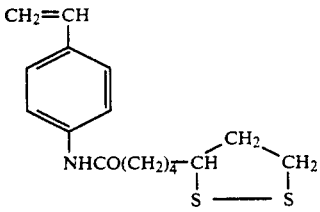
(32)
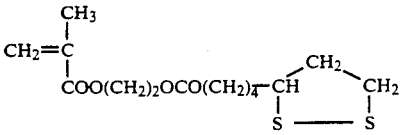
(33)
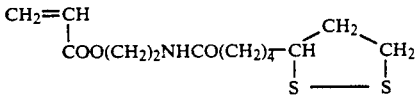
(34)
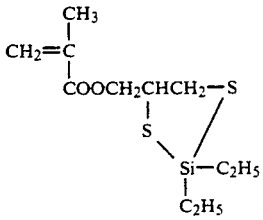
-continued
(35)
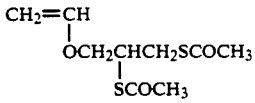
(36)
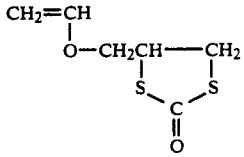
(40)
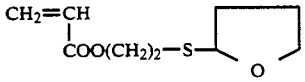
(41)
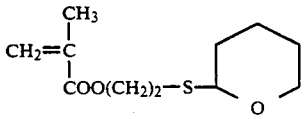
(42)
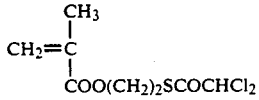
(43)
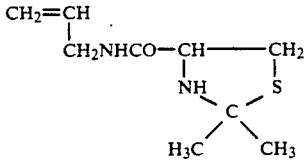
(44)
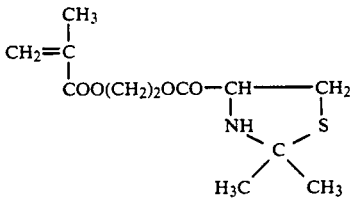
(45)
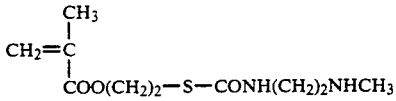
Detailed reference will now be made to the functional group which is decomposed to form at least one phospho group such as that having the following general formula (14) or (15):
(14)
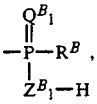
or
(15)
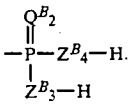

In Formula (14), $R^B$ stands for a hydrocarbon group or a group $—Z^{B_2}—R^{B'}$ where $R^{B'}$ denotes a hydrocarbon and $Z^{B_2}$ indicates an oxygen or sulfur atom.

$Q^{B_1}$ stands for an oxygen or sulfur atom. $Z^{B_1}$ denotes an oxygen or sulfur atom. In Formula (15), $Q^{B_2}$, $Z^{B_3}$ and $Z^{B_4}$ each independently represent an oxygen or sulfur atom.

Preferably, $R^B$ stands for a $C_{1-4}$ alkyl group which may have a substituent (e.g., a methyl, ethyl, propyl or butyl group0 or a group $—Z^{B_2}—R^{B'}$ wherein $Z^{B_2}$ denotes an oxygen or sulfur atom.

$R^{B'}$ has the same meanings as defined for $R^B$.

$Q^{B_1}$, $Q^{B_2}$, $Z^{B_1}$, $Z^{B_3}$ and $Z^{B_4}$ each independently stand for an oxygen or sulfur atom.

Specifically but not exclusively, the functional group, which forms the phospho group having the general formula (14) or (15) upon decomposition, is expressed by the following general formulae (16) and/or (17).

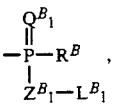

(16)

and

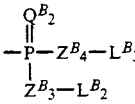

(17)

In Formulae (16) and (17), $Q^{B_1}$, $Q^{B_2}$, $Z^{B_1}$, $Z^{B_3}$, $Z^{B_4}$ and $R^B$ have the same meanings as defined in connection with Formulae (14) and (15).

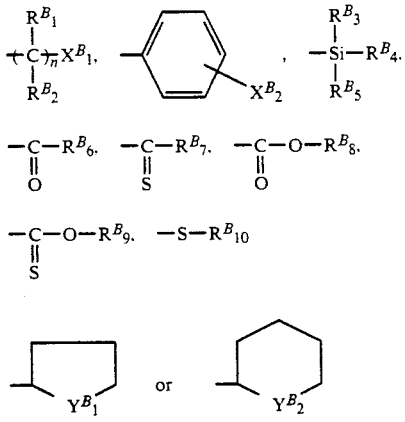

When $L^{B_1}$ to $L^{B_3}$ denote

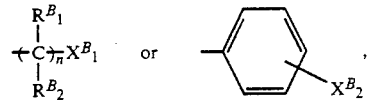

$R^{B_1}$ and $R^{B_2}$ may be identical with or different from each other, and each stand for a hydrogen atom, a halogen atom (e.g., a chlorine, bromine or fluorine atom) or a methyl group. $X^{B_1}$ and $X^{B_2}$ each represent an electron attractive group. It is here noted that the term "electron attractive group" refers to a group whose Hammett's $\sigma$ value is positive, for instance, a halogen atom,

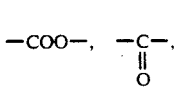

$—SO_2—$, —CN, and $—NO_2$. Preferably, $X^{B_1}$ and $X^{B_2}$ each denote a halogen atom (e.g., a chlorine, bromine or fluorine atom), —CN, $—CONH_2$, $—NO_2$ or $—SO_2R^{B''}$ where $R^{B''}$ is a hydrocarbon group such as a methyl, ethyl, propyl, butyl, hexyl, benzyl, phenyl, tolyl, xylyl or mesityl group). n stands for 1 or 2. Further, when $X^{B_1}$ is a methyl group, both $R^{B_1}$ and $R^{B_2}$ are methyl groups with n=2.

When $L^{B_1}$ to $L^{B_3}$ stand for

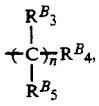

$R^{B_3}$, $R^{B_4}$ and $R^{B_5}$ may be identical with or different from each other, and each preferably denote a hydrogen atom, a $C_{1-18}$ straight-chain or branched alkyl group which may have a substituent (e.g., a methyl, ethyl, propyl, butyl, hexyl, octyl, dodecyl, octadecyl, chloroethyl, methoxyethyl or methoxypropyl group), an alicyclic group which may have a substituent (e.g., a cyclopentyl or cyclohexyl group), a $C_{7-12}$ aralkyl group which may have a substituent (e.g., a benzyl, phenethyl, chlorobenzyl or methoxybenzyl group), an aromatic group which may have a substituent (e.g., a phenyl, naphthyl, chlorophenyl, tolyl, methoxyphenyl, methoxycarbophenyl or dichlorophenyl group) or a group $—O—R^{B'''}$ where $R^{B'''}$ is a hydrocarbon group, for example, such substituents as referred to in connection with the above-described $R^{B_3}$, $R^{B_4}$ and $R^{B_5}$.

When $L^{B_1}$ to $L^{B_3}$ stand for

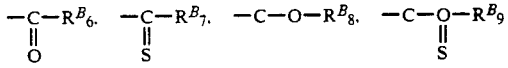

or $—S—R^{B_{10}}$, $R^{B_6}$, $R^{B_7}$, $R^{B_8}$, $R^{B_9}$ and $R^{B_{10}}$ each independently represent a hydrocarbon group, preferably, a $C_{1-6}$ straight-chain or branched alkyl group which may have a substituent (e.g., a methyl, trichloromethyl, trifluoromethyl, methoxymethyl, phenoxymethyl, 2,2,2-trifluoroethyl, ethyl, propyl, hexyl, t-butyl or hexafluoroisopropyl group), a $C_{7-9}$ aralkyl group which may have a substituent (e.g., a benzyl, phenethyl, methylbenzyl, trimethylbenzyl, heptamethylbenzyl or methoxybenzyl group), a $C_{6-12}$ aryl group which may have a substituent (e.g., a phenyl, tolyl, xylyl, nitrophenyl, cyanophenyl or methanesulfonylphenyl, methoxyphenyl, butoxyphenyl, chlorophenyl, dichlorophenyl or trifluoromethylphenyl group).

Further, when $L^{B_1}$ to $L^{B_3}$ are

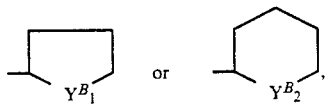

$Y^{B_1}$ and $Y^{B_2}$ each stand for an oxygen or sulfur atom.

The monomer used in this invention and containing at least one functional group may be synthesized by the introduction of a protective group according to manners known so far in the art. The introduction of the protective group may be achieved as by the procedure set forth in J. F. W. McOmie, "Protective groups in Organic Chemistry", Chapter 6 (published by Plenum Press in 1973), a synthesis reaction similar to the procedure for introducing protective groups into hydroxyl groups—described in "Shin Jikken Kagaku Koza—Synthesis and Reactions of Organic Compounds [V]" edited by the Japan Chemical Society, p2497, (published by Maruzen Co., Ltd. in 1978) or a synthesis reaction similar to the procedure of introducing protective groups into thio groups described in S. Patai, "The Chemistry of the Thiol Groups Part 2", Chapters 13 and 14 (published by Wiley-Interscience in 1974) and T. W. Greene, "Protective Groups in Organic Synthesis", Chapter 6 (published by Wiley-Interscience in 1981).

Specific compounds that can become the recurring unit of a polymeric component containing the functional group having the general formulae (16) and/or (17) and used as a protective group may include the following compounds:

(46)

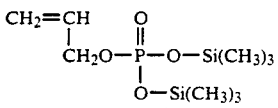

(47)

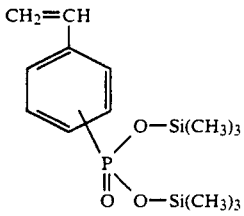

(48)

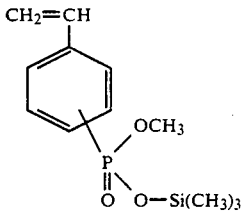

(49)

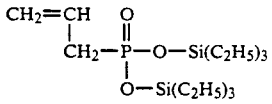

a = H, $-CH_3$ (50)

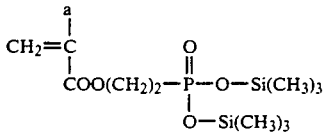

(51)

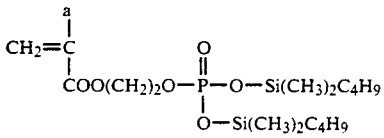

-continued (52)

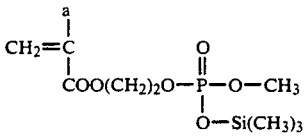

(53)

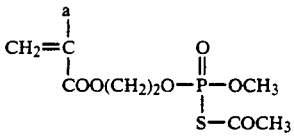

(54)

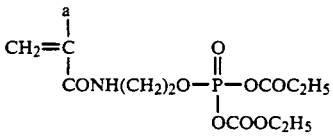

(55)

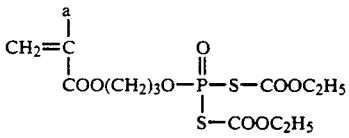

(56)

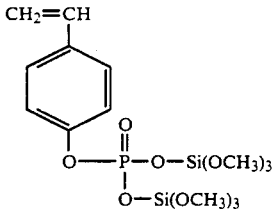

(57)

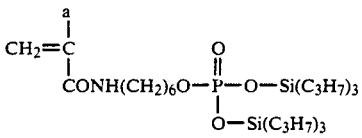

(58)

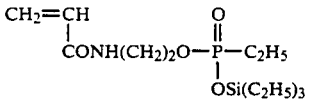

(59)

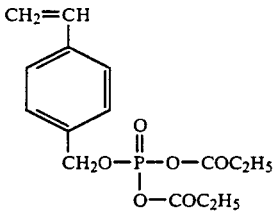

(60)

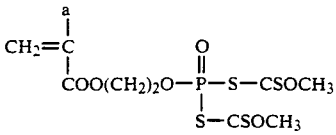

-continued (61)

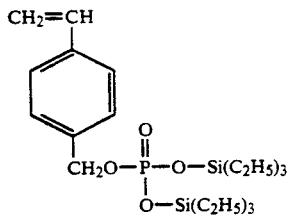

(62)

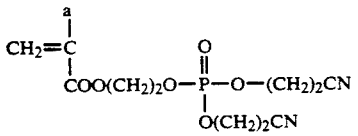

(63)

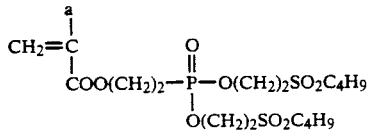

The functional group which forms an amino group, e.g., groups $—NH_2$ and/or $—NHR^C$ upon decomposition, for instance, may be represented by the following general formulae (18)–(20):

(18)

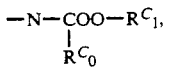

(19)

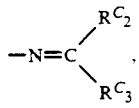

and (20)

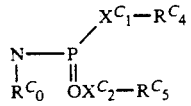

In the above-described formulae (18) and (20), $R^{C_0}$ stands for a hydrogen atom, a $C_{1-12}$ alkyl group which may have a substituent (e.g., a methyl, ethyl, propyl, butyl, hexyl, octyl, decyl, dodecyl, 2-chloroethyl, 2-bromoethyl, 3-chloropropyl, 2-cyanoethyl, 2-methoxyethyl, 2-ethoxyethyl, 2-methoxycarbonylethyl, 3-methoxypropyl or 6-chlorohexyl group), an optionally substituted alicylic group having 5–8 carbon atoms (e.g., a cyclopentyl or cyclohexyl group), a $C_{7-12}$ aralkyl group which may have a substituent (e.g., a benzyl, phenethyl, 3-phenylpropyl, 1-phenylpropyl, chlorobenzyl, methoxybenzyl, bromobenzyl or methylbenzyl group) or a $C_{6-12}$ aryl group which may have a substituent (e.g., a phenyl, chlorophenyl, dichlorophenyl, tolyl, xylyl, mesityl, chloromethyl, chlorophenyl, methoxyphenyl, ethoxyphenyl or chloromethoxyphenyl group).

When $R^{C_0}$ stands for a hydrocarbon group, it should preferably have 1–8 carbon atoms.

In the functional group having the above-described formula (18), $R^{C_1}$ denotes a $C_{1-12}$ aliphatic group which may have a substituent, more specifically, a group having the following general formula (21):

(21)

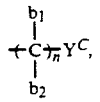

In the above-described formula (21), $b_1$ and $b_2$ each stand for a hydrogen atom, a halogen atom (e.g., a fluorine or chlorine atom) or a $C_{1-12}$ hydrocarbon group which may have a substituent (e.g., a methyl, ethyl, propyl, butyl, hexyl, methoxymethyl, ethoxymethyl, 2-methoxyethyl, 2-chloroethyl, 3-bromopropyl, cyclohexyl, benzyl, chlorobenzyl, methoxybenzyl, methylbenzyl, phenethyl, 3-phenylpropyl, phenyl, tolyl, xylyl, mesityl, chlorophenyl, methoxyphenyl, dichlorophenyl, chloromethylphenyl or naphthyl group); $Y^C$ denotes a hydrogen atom, a halogen atom (e.g., a fluorine or chlorine atom), a cyano group, an alkyl group having 1–4 carbon atoms (e.g., a methyl, ethyl, propyl or butyl group), an aromatic group which may have a substituent (e.g., a phenyl, tolyl, cyanophenyl, 2,6-dimethylphenyl, 2,4,6-tirmethylphenyl, heptamethylphenyl, 2,6-dimethoxyphenyl, 2,4,6-trimethoxyphenyl, 2-propylphenyl, 2-butylphenyl, 2-chloro-6-methylphenyl or furanyl group) or a group $—SO_2—R^{C_6}$ where $R^{C_6}$ has the same meanings as mentioned in connection with the hydrocarbon group defined for $Y^C$; and n represents 1 or 2.

When $Y^C$ is a hydrogen atom or an alkyl group, it is more preferable that $b_1$ and $b_2$ on the carbon atom adjacent to the oxygen atom of the urethane bond each stand for a substituent other than a hydrogen atom.

It is noted, however, that when $Y^C$ is neither a hydrogen atom nor an alkyl group, $b_1$ and $b_2$ may each be any one of the above-mentioned members.

In the formula

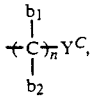

it is preferable that $b_1$ and $b_2$ forms a group containing at least one electron attractive group or the carbon atoms adjacent to the oxygen atom of the urethane bond form a sterically bulky group.

$R^{C_1}$ stands for an alicyclic group (e.g., a monocyclic hydrocarbon group like a cyclopropyl, cyclobutyl, cyclopentyl, cyclohexyl, 1-methyl-cyclohexyl or 1-methylcyclobutyl group or a crosslinked ring type hydrocarbon group like a bicyclooctane, bicyclooctene, bicyclononane or ticycloheptane group).

In the above-mentioned formula (19), $R^{C_2}$ and $R^{C_3}$ may be identical with or different from each other, and each stands for a hydrocarbon group having 1–12 carbon atoms or, more specifically, has the same meanings as mentioned in connection with the aliphatic or aromatic group for $Y^C$ in the above-described formula (19).

In the above-described formula (20), $X^{C_1}$ and $X^{C_2}$ may be identical with or different from each other, and each denote an oxygen or sulfur atom. $R^{C_4}$ and $R^{C_5}$ may be identical with or different from each other, and each denote a hydrocarbon group having 1–8 carbon atoms or, more specifically, the aliphatic or aromatic group mentioned in connection with $Y^C$ of the above-described formula (18).

Specific examples of the functional groups having the above-mentioned formulae (18)–(20) are given below, by way of example alone.
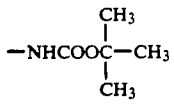
(64)
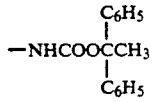
(65)
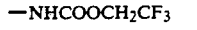
(66)
(67)
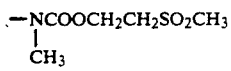
(68)
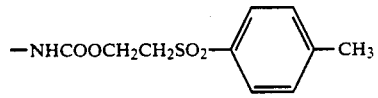
(69)
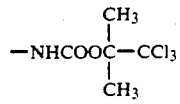
(70)
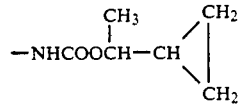
(71)
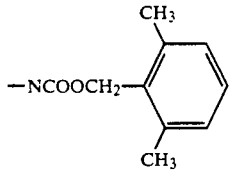
(72)
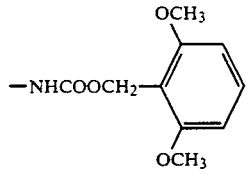
(73)
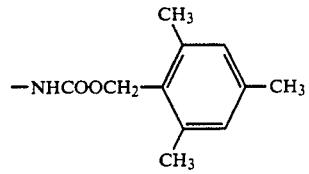
(74)
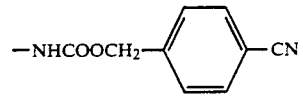
(75)
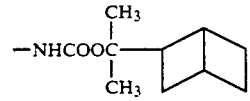
(76)
-continued
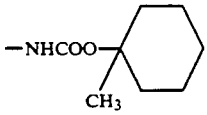
(77)
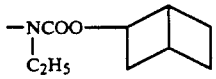
(78)
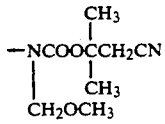
(79)
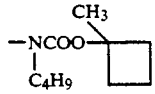
(80)
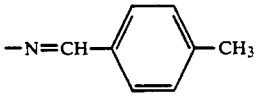
(81)
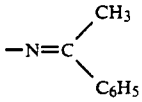
(82)
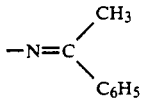
(83)
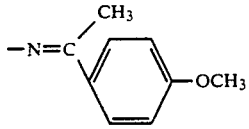
(84)
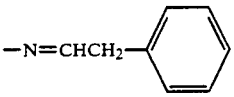
(85)
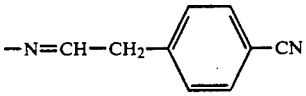
(86)
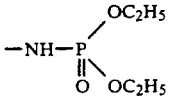
(87)
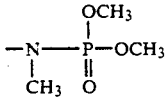
(88)
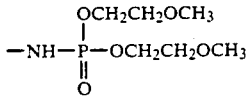
(89)

-continued

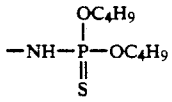

(90)

The monomer used in this invention and containing at least one of the functional groups which form an amino group upon decomposition, for instance, one selected from the above-described formulae (19)-(21) may be prepared by such procedures as set forth in "Shin Jikken Kagaku Koza, Vol. 14—Synthesis and Reactions of Organic Compounds (V)", edited by the Japan Chemical Society, page 2555 (published by Maruzen Co., Ltd.), J. F. W. McOmie, "Protective groups in Organic Chemistry", Chapter 2, (published by Plenum Press in 1973) and "Protective groups in Organic Synthesis", Chapter 7 (published by John Wiley & Sons in 1981).

The functional groups which form at least one sulfon group upon decomposition, for instance, may be expressed by the following general formula (22) or (23):

$$-SO_2-O-R^{D}_{1}, \quad (22),$$

and $$-SO_2-S-R^{D}_{2}. \quad (23)$$

In Formula (22), $R^{D}_{1}$ represents the following groups:

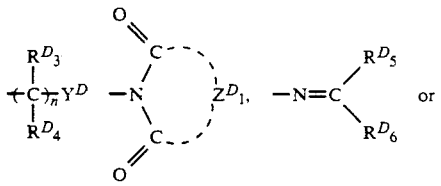

$-NHCOR^{D}_{7}$

In Formula (23), $R^{D}_{2}$ stands for a $C_{1-18}$ aliphatic group which may have a substituent or a $C_{6-22}$ aryl group which may have a substituent.

In the ensuing description, detailed reference will be made to the functional groups having the above-described formulae (22) and (23) forming sulfon groups upon decomposition.

When $R^{D}_{1}$ stands for

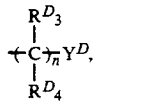

$R^{D}_{3}$ and $R^{D}_{4}$ may be identical with or different from each other, and each represent a hydrogen atom, a halogen atom (e.g., a fluorine, chlorine or bromine atom) or an alkyl group having 1-6 carbon atoms (e.g., a methyl, ethyl, propyl, butyl, pentyl or hexyl group). $Y^{D}$ denotes a $C_{1-18}$ alkyl group which may have a substituent (e.g., a methyl, ethyl, propyl, butyl, pentyl, hexyl, octyl, decyl, dodecyl, hexadecyl, trifluoromethyl, methanesulfonylmethyl, cyanomethyl, 2-methoxyethyl, ethoxyethyl, chloromethyl, dichloromethyl, trichloromethyl, 2-methoxycarbonylphenyl, 2-propoxycarbonylethyl, methylthiomethyl or ethylthiomethyl group), a $C_{2-18}$ alkenyl group which may have a substituent (e.g., a vinyl or allyl group), a $C_{6-12}$ aryl group which may have a substituent (e.g., a phenyl, naphthyl, nitrophenyl, dinitrophenyl, cyanophenyl, trifluoromethylphenyl, methoxycarbonylphenyl, butoxycarbonylphenyl, methanesulfonylphenyl, benzenesulfonylphenyl, tolyl, xylyl, acetoxyphenyl or nitronaphtyl group) or a group

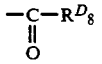

where $R^{D}_{8}$ stands for an aliphatic or aromatic group or, more specifically, has the same meanings as mentioned in connection with the substituents for the above-described $Y^{D}$. n indicates 0, 1 or 2.

More preferably, the subsituent

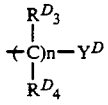

contains at least one electron attractive group. More specifically, when n=1 or 2 and $Y^{D}$ is a hydrocarbon group which does not contain an electron attractive group as a substituent, the substituent

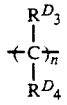

contains at least one halogen atom. When n=0, 1 or 2, $Y^{D}$ contains at least one electron attractive group. Furthermore, mentioned are

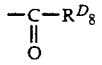

and

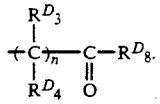

In another preferable embodiment of $-SO_2-O-R^{D}$, at least two carbon atoms are attached to the carbon atom adjacent to the oxygen atom. Alternatively, when n=o or 1 and $Y^{D}$ is an aryl group, the aryl group has substituents at the 2- and 6-position If $R^{D}_{1}$ stands for

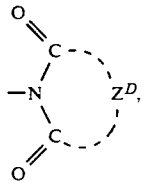

then $Z^{D}$ denotes an organic residue forming a cyclic imido group. Preferably, the organic residue has the following general formula (24) or (25):

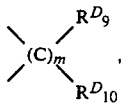

(24)

or

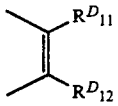

(25)

In Formula (24), $R^{D}_{9}$ and $R^{D}_{10}$ may be identical with or different from each other, and each have same meanings as described in connection with $R_9$ and $R_{10}$ in the foregong general formula 3. In the general formula (25), $R^{D}_{11}$ and $R^{D}_{12}$ may be identical with or different from each other, and each have the same meanings as defined in connection with $R_{11}$ and $R_{12}$ in the foregoing general formula 4.

If $R^{D}_{1}$ stands for

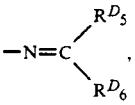

then $R^{D}_{5}$ and $R^{D}_{6}$ each denote a hydrogen atom, an aliphatic group (e.g., those already mentioned in connection with the foregoing $Y^{D}$) or an aryl group (e.g., those already mentioned in connection with the foregoing $Y^{D}$). It is to be noted, however, that $R^{D}_{5}$ and $R^{D}_{6}$ do not represent hydrogen atoms at the same time.

If $R^{D}_{1}$ stands for $-NHCOR^{D}_{7}$, then $R^{D}_{7}$ denotes an aliphatic or aryl group or, more specifically, those already mentioned in connection with the foregoing $Y^{D}$.

In Formula (23), $R^{D}_{2}$ denotes a $C_{1-18}$ aliphatic group which may have a substituent or a $C_{6-12}$ aryl group which may have a substituent.

More specifically, $R^{D}_{2}$ should be identical with the aliphatic or aryl groups for $Y^{D}$ referred to in the general formula (22).

The monomer containing at least one functional group selected from the group consisting of the general formulae $[-SO_2-O-R^{D}_{1}]$ and $[-SO_2-O-R^{D}_{2}]$ may be synthesized on the basis of known knowledges of organic reactions.

For instance, this synthesis may be achieved, as is the case with the protective reactions of carboxyl groups set forth in J. F. W. McOmie, "Protective groups in Organic Chemistry" published by Plenum Press in 1973 and T. W. Greene, "Protective groups in Organic Synthesis" published by John Wiley & Sons in 1980.

More specifically but not exclusively, scores of the functional groups represented by $$-SO_2-O-R^{D}_{1} \quad (22)$$

or $$-SO_2-O-R^{D}_{2} \quad (23)$$

are set out below.

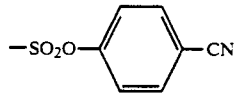

(91)

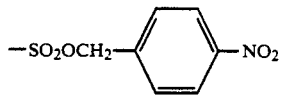

(92)

$-SO_2OCH_2CF_3$ (93)

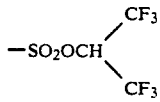

(94)

$-SO_2OCH_2(CHF)_2CH_2F$ (95)

$-SO_2OCH_2CCl_3$ (96)

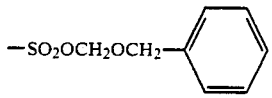

(97)

$-SO_2O(CH_2)_2SO_2C_4H_9$ (98)

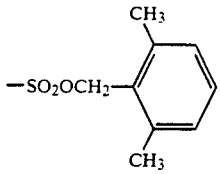

(99)

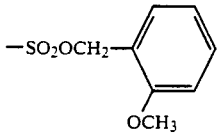

(100)

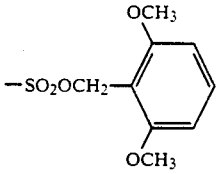

(101)

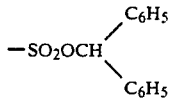

(102)

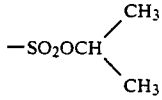

(103)

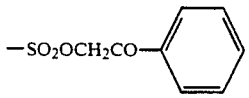

(104)

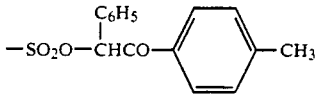

(105)

-continued (106)

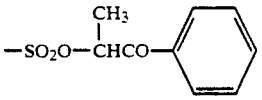

(107)

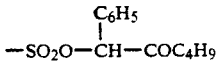

(108) $-SO_2O(CH_2)_2SO_2C_2H_5$ (109) $-SO_2SC_4H_9$ (110) $-SO_2SC_6H_{13}$ (111) $-SO_2S(CH_2)_2OC_2H_5$ (112)

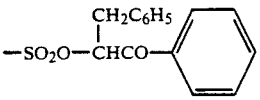

(113) $-SO_2OCH_2CHFCH_2F$ (114)

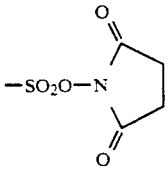

(115)

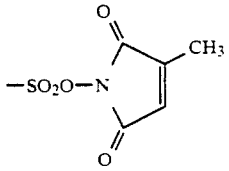

(116)

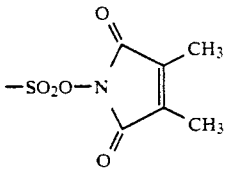

(117)

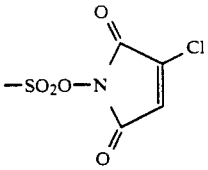

(118)

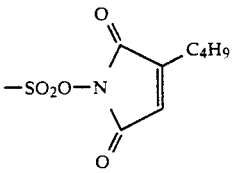

(119)

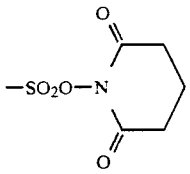

-continued (120)

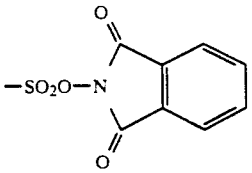

(121)

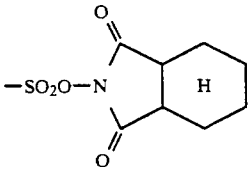

(122)

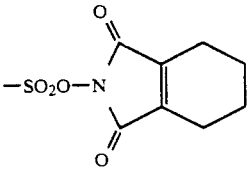

(123)

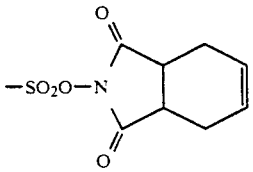

Reference will now be made to the monofunctional monomer (B) containing a substituent having at least one fluorine and/or silicon atoms, which can be copolymerized with the monomer (A) containing a functional group which forms a carboxyl group upon decomposition or a functional group which forms a hydrophilic group upon decomposition. For the monofunctional monomer (B) according to this invention use may be made of any desired compound conforming to the above-mentioned requirements. Set out below are specific examples of the substituents. However, it is to be noted that this invention is not limited to the exemplified chemical structures.

The substituents containing a fluorine atom, for instance, may be represented by $-C_hH_{2h+1}$ where h is an integer of 1-12, $-(CF_2)_jCF_2H$ where j is an integer of 1-11 or

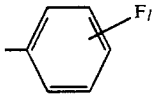

where l is an integer of 1-6.

The substituents containing a silicon atom, for instance, may be represented by

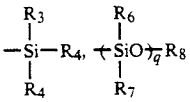

where q is an integer of 1-20, or a polysiloxane structure.

However, $R_3$, $R_4$ and $R_5$ may be identical with or different from each other, and each denote a hydrocarbon group which may have a substituent or a group —$OR_9$ where $R_9$ may be the same hydrocarbon group as will be described in connection with $R_3$.

$R_3$ denotes a $C_{1-18}$ alkyl group which may have a substituent (e.g., a methyl, ethyl, propyl, butyl, hexyl, octyl, decyl, dodecyl, hexadecyl, 2-chloroethyl, 2-bromoethyl, 2,2,2-trifluoroethyl, 2-cyanoethyl, 3,3,3-trifluoropropyl, 2-methoxyethyl, 3-bromopropyl, 2-methoxycarbonylethyl or 2,2,2,2',2',2'-hexafluoroisopropyl group), a $C_{4-18}$ alkenyl group which may have a substituent (e.g., a 2-methyl-1-propenyl, 2-butenyl, 2-pentenyl, 3-methyl-2-pentenyl, 1-pentenyl, 1-hexenyl, 2-hexenyl or 4-methyl-2-hexenyl group), a $C_{7-12}$ aralkyl group which may have a substituent (e.g., a benzyl, phenethyl, 3-phenylpropyl, naphthylmethyl, 2-naphthylethyl, chlorobenzyl, bromobenzyl, methylbenzyl, ethylbenzyl, methoxybenzyl, dimethylbenzyl or dimethoxybenzyl group), a C5-8 alicyclic group which may have a substituent (e.g., a cyclohexyl, 2-cyclohexyl or 2-cyclopentylethyl group) or a $C_{6-12}$ aromatic group which may have a substituent (e.g., a phenyl, naphthyl, tolyl, xylyl, propylphenyl, butylphenyl, octylphenyl, dodecylphenyl, methoxyphenyl, ethoxyphenyl, butoxyphenyl, decyloxyphenyl, chlorophenyl, dichlorophenyl, bromophenyl, cyanophenyl, acetylphenyl, methoxycarbonylphenyl, ethoxyphenylcarbonylphenyl, butoxycarbonylphenyl, acetamidophenyl, propioamidophenyl or decyloylamidophenyl group.

$R_6$, $R_7$ and $R_8$ may be identical with or different from each other, and have the same meanings as defined for the above-described $R_3$, $R_4$ and $R_5$.

More specifically but not exclusively, specific examples of the monofunctional monomer (B) containing a fluorine and/or silicon atoms will be set out just below.

(b-1)

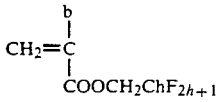

b: H, $CH_3$
h: an integer of 1-12

(b-2)

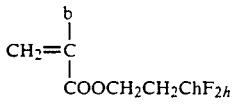

(b-3)

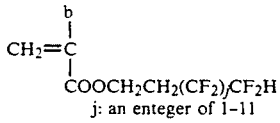

j: an enteger of 1-11

(b-4)

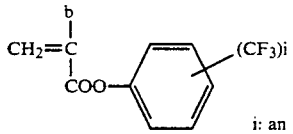

i: an integer of 1-3

(b-5)

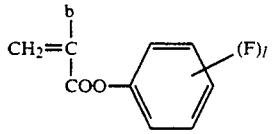

l: an integer of 2-5

(b-6)

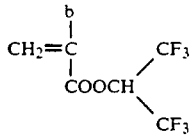

-continued (b-7)

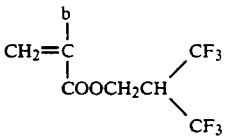

(b-8)

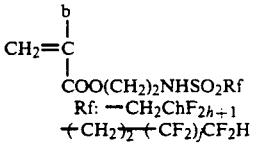

(b-9)

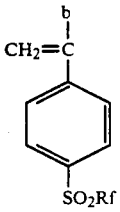

(b-10)

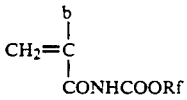

(b-11)

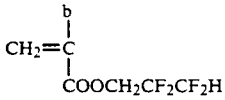

(b-12)

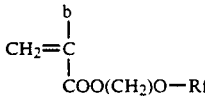

(b-13)

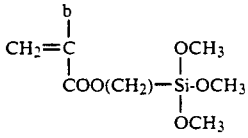

(b-14)

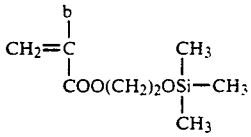

(b-15)

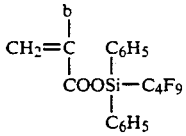

(b-16)

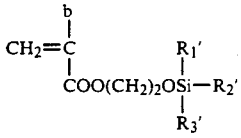

$R_1'$, $R_2'$, $R_3'$: each denote an alkyl group having 1-12 carbon atoms (b-17)

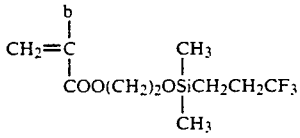

-continued (b-18)

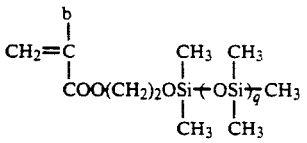

q: an interger of 1-20

(b-19)

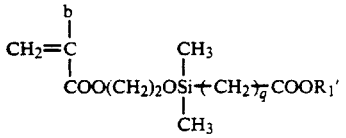

(b-20)

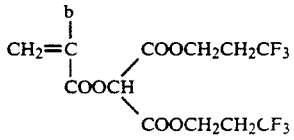

(b-21)

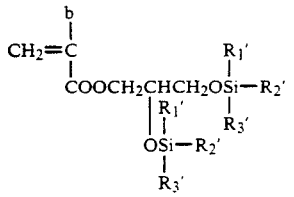

(b-22)

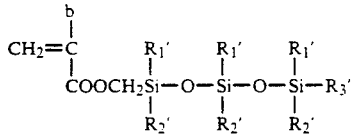

(b-23)

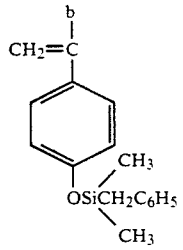

(b-24)

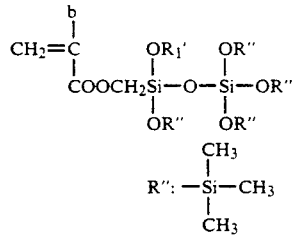

(b-25)

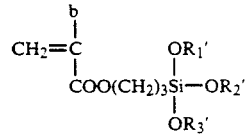

(b-26)

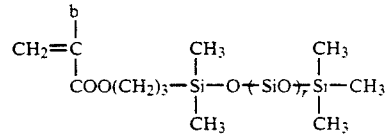

r: 0 or an integer of 1-20

-continued (b-27)

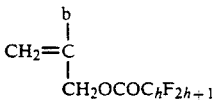

(b-28)

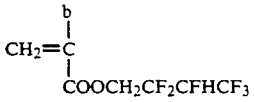

(b-29)

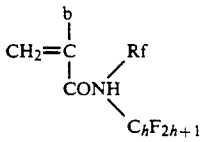

In addition to the polar group-containing monomer (A) and the fluorine and/or silicon atom-containing monomer (B), the resin according to this invention may include other copolymerizable monomer or monomers as a polymeric component or components.

Examples of the above-mentioned other monomers, for instance, include α-olefins, alkane acid vinyl or ally esters, acrylonitrile, methacrylonitrile, vinyl ethers, acrylamides, methacrylamides, styrenes and heterocyclic vinyls [e.g., five to seven-membered heterocyclic compounds having 1-3 nonmetal atoms (like oxygen and sulfur atoms) other than a nitrogen atom, such as vinylthiophene, vinyldioxane and vinylfuran]. More preferably but not exclusively, mention is made of $C_{1-3}$ alkane acid vinyl or allyl esters, methacrylonitrile, styrene and styrene derivatives (e.g., vinyltoluene, butylstyrene, methoxystyrene, chlorostyrene, dichlorostyrene, bromostyrene or methoxystyrene).

The resin according to this invention contains the monomer (A) in an amount of at least 30% by weight, preferably at least 50% by weight and the monomer (B) in an amount lying in the range of 0.5 to 30% by weight, preferably 1 to 20% by weight. The amount of other copolymerizable monomer or monomers, if contained, is at most 20% by weight.

Of importance for the polymeric components insoluble in nonaqueous solvents is that they should have such hydrophilic nature as expressed by an angle of contact with distilled water of up to 50°.

The resin for stabilizing dispersion according to this invention will now be explained. Of importance for this dispersion-stabilizing resin is that it can be solvated and soluble in a nonaqueous solvent. The dispersion-stabilizing resin takes a part in stabilizing dispersion in the so-called nonaqueous dispersion polymerization and, more specifically, must be dissolved at 25° C. in an amount of at least 5% by weight with respect to 100 parts by weight of said solvent.

The dispersion-stabilizing resin has a weight-average molecular weight lying in the range of $1\times10^3$ to $5\times10^5$, preferably $2\times10^3$ to $1\times10^5$, more preferably $3\times10^3$ to $5\times10^4$. In a weight-average molecular weight less than $1\times10^3$, the resulting dispersed resin particles coagulate, giving fine particles of varying particle sizes. At higher than $5\times10^5$, on the other hand, the effect of this invention—when added to a photoconductive layer, the particles are improved in terms of water retention while conforming to electrophotographic properties—becomes slender.

For the dispersion-stabilizing resin of this invention, any desired polymer may be used, if it is soluble in the above-mentioned nonaqueous solvent. More specifically, use may be made of those referred to in the outlines of the following literature:

K. E. J. Barrett, "Dispersion Polymerization in Organic Media", published by John Wiley and Sons in 1975;

R. Dowpenco and D. P. Hart, "Ind. Eng. Chem. Prod. Res. Develop.", 12, (No. 1), 14 (1973); Toyokichi. Tange, "Nippon Setchaku Kyokukai-Shi", 23 (1), 26 (1987);

D. J. Walbridge, "NATO. Adv. Study Inst. Ser. E.", Nos. 67, 40 (1983); and

Y. Sasaki and M. Yabuta, "Proc. 10th. Int. Conf. Org. Coat. Sci. Technol.", 10, 263 (1984).

For instance, mention may be made of olefin polymers, modified olefin polymers, styrene-olefin copolymers, aliphatic carboxylic acid vinyl ester copolymers, modified anhydrous maleic acid copolymers, polyester copolymers, polyether polymers, methacrylate homopolymers, acrylate homopolymers, methacrylate copolymers, acrylate copolymers and alkyd resin.

More specifically, the polymeric component provided in the form of the recurring unit of the dispersion-stabilizing resin according to this invention has the following general formula (26):

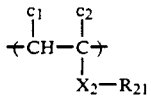

(26)

In the above-mentioned formula (26), $X_2$ has the same meanings as will be defined and explained at great length for $V_0$ in the general formula (1) to be referred to later.

$R_{21}$ denotes a $C_{1-22}$ alkyl group which may have a substituent (e.g., a methyl, ethyl, propyl, butyl, pentyl, hexyl, octyl, nonyl, decyl, dodecyl, tridecyl, tetradecyl, hexadecyl, octadecyl, docosanyl, 2-(N,N-dimethylamino)ethyl, 2-N-morpholino)ethyl, 2-chloroethyl, 2-bromoethyl, 2-hydroxyethyl, 2-cyanoethyl, 2-(α-thienyl)ethyl, 2-carboxyethyl, 2-methoxycarbonylethyl, 2,3-epoxypropyl, 2,3-diacetoxypropyl, 3-chloropropyl or 4-ethoxycarbonylbutyl group), a $C_{3-22}$ alkenyl group which may have a substituent (e.g., an allyl, hexenyl, octenyl, docenyl, dodecenyl, tridecenyl, octadecenyl, oleyl or linolenyl group), a $C_{7-22}$ aralkyl group which may have a substituent (e.g., a benzyl, phenethyl, 3-phenylpropyl, 2-naphthylmethyl, 2-(2'-naphthyl)ethyl, chlorobenzyl, bromobenzyl, methylbenzyl, dimethylbenzyl, trimethylbenzyl, methoxybenzyl, dimethoxybenzyl, butylbenzyl or methoxycarbonylbenzyl), a $C_{4-12}$ alicyclic group which may have a substituent (e.g., a cyclopentyl, cyclohexyl, cyclooctyl, adamantyl, chlorocyclohexyl, methylcyclohexyl or methoxycyclohexyl group) or a $C_{6-22}$ aromatic group which may have a substituent (e.g., a phenyl, tolyl, xylyl, mesityl, naphthyl, anthranyl, chlorophenyl, bromophenyl, butylphenyl, hexylphenyl, octylphenyl, decylphenyl, dodecylphenyl, methoxyphenyl, ethoxyphenyl, octyloxyphenyl, ethoxycarbonylphenyl, acetylphenyl, butoxycarbonylphenyl, butylmethylphenyl, N,N-dibutylaminophenyl, N-methyl-N-dodecylphenyl, thienyl or pyranyl group).

$c_1$ and $c_2$ have the same meanings as will be defined and explained at great length with reference to $a_1$ and $a_2$ in the general formula (1) to be referred to later.

In addition to the above-mentioned components, the dispersion-stabilizing resin of this invention may contain other polymeric component or components.

For the aforesaid other polymeric components, use may be made of those copolymerizable with the monomer corresponding to the component represented by the general formula (26). For instance, mention may be made of α-olefins, acrylonitrile, methacrylonitrile, vinyl-containing heterocyclic compounds (e.g., pyran, pyrrolidone, imidazole and pyridine compounds), vinyl group-containing carboxylic acids (e.g., acrylic, methacrylic, crotonic, itaconic and maleic acids) and vinyl group-containing carboxyamides (e.g., acrylamide, methacrylamide, crotonic acid amide, itaconic acid amide, itaconic acid half amide and itaconic acid diamide).

In the dispersion-stabilizing resin of this invention, the polymeric component represented by the general formula (26) amounts to at least 30 parts by weight, preferably at least 50 parts by weight relative to 100 parts by weight of the total polymer of said resin.

The dispersion-stabilizing resin of this invention may also contain photo- and/or thermo-setting groups in an amount of up to 30 parts by weight, preferably up to 20 parts by weight based on 100 parts by weight of the total polymer of said resin.

For the photo-and/or thermo-setting functional groups to be contained, use may be made of functional groups other than polymerizable functional groups, more specifically, those for forming crosslinked particle structure, as will be described later.

More preferably, the dispersion-stabilizing resin of this invention contains in its polymer chain at least one polymerizable double bond moiety represented by the following general formula (1), as will be explained just below.

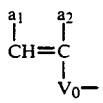

(1)

In the above-mentioned formula (1), $V_0$ represents —O—, —COO—, —OCO—,

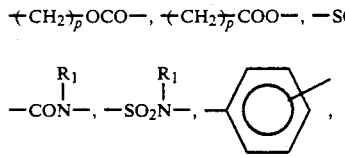

—CONHCOO— or —CONHCONH—, wherein p is an integer of 1 to 4.

Here $R_1$ denotes a hydrogen atom or a hydrocarbon group, more preferably, a $C_{1-18}$ alkyl group which may have a substituent (e.g., a methyl, ethyl, propyl, butyl, heptyl, hexyl, octyl, decyl, dodecyl, hexadecyl, octadecyl, 2-chloroethyl, 2-bromoethyl, 2-cyanoethyl, 2-methoxycarbonylethyl, 2-methoxyethyl or 3-bromopropyl group), a $C_{4-18}$ alkenyl group which may have a substituent (e.g., a 2-methyl-1-propenyl, 2-butenyl, 2-pentenyl, 3-methyl-2-pentenyl, 1-pentenyl, 1-hexenyl, 2-hexenyl or 4-methyl-2-hexenyl group), a $C_{7-12}$ aralkyl group which may have a substituent (e.g., a benzyl, phenethyl, 3-phenylpropyl, naphthylmethyl, 2-naphthylethyl, chlorobenzyl, bromobenzyl, methylbenzyl, ethylbenzyl, methoxy-benzyl, dimethylbenzyl or dimethoxybenzyl group), a $C_{5-8}$ alicyclic group which may have a substituent (e.g., a cyclohexylethyl, 2-cyclohexylethyl or 2-cyclopentylethyl group) or a $C_{6-12}$ aromatic group which may have a substituent (e.g., a phenyl, naphthyl, tolyl, xylyl, propylphenyl, butylphenyl, octylphenyl, dodecylphenyl, methoxyphenyl, ethoxyphenyl, butoxyphenyl, decyloxyphenyl, chlorophenyl, dichlorophenyl, bromophenyl, cyanophenyl, acetylphenyl, methoxycarbonylphenyl, ethoxy-carbonylphenyl, butoxycarbonylphenyl, acetamidophenyl, propioamidophenyl or dodecyloylamidophenyl group).

If $V_0$ denotes

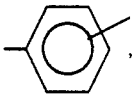

the benzene ring may have a substituent such as a halogen atom (e.g., a chlorine or bromine atom), an alkyl group (e.g., a methyl, ethyl, propyl, butyl, chloromethyl or methoxymethyl group) or an alkoxy group (e.g., a methoxy, ethoxy, propoxy or butoxy group).

$a_1$ and $a_2$ may be identical with or different from each other, and each preferably stands for a hydrogen atom, a halogen atom (e.g., a chlorine or bromine atom), a cyano group, a $C_{1-4}$ alkyl group (e.g., a methyl, ethyl, propyl or butyl group), or a group —COO—$R_2$ or —$COOR_2$ having a hydrocarbon group in it, wherein $R_2$ denotes a hydrogen atom or a $C_{1-18}$ alkyl, alkenyl, aralkyl, alicyclic or aryl group which may have a substituent) or, more specifically, indicates those mentioned in connection with the above-mentioned $R_1$.

For the hydrocarbon group contained in the above-described group —$COOR_2$, mention may be made of a methylene, ethylene or propylene group, by way of example alone.

In the aforesaid general formula (1), it is further preferred that $V_0$ denotes —COO—, —OCO—, —$CH_2$OCO—, —$CH_2$COO—, —O—, —CONH—, —$SO_2$NH—, —CONHCOO— or

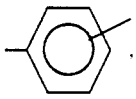

and $a_1$ and $a_2$ may be identical with or different from each other, and each stand for a hydrogen atom, a methyl group or a group —$COOR_2$ or —$CH_2COOR_2$ where $R_2$ is a hydrogen atom or a $C_{1-6}$ alkyl group (e.g., a methyl, ethyl, propyl, butyl or hexyl group). More preferably, either $a_1$ or $a_2$ should stand for a hydrogen atom.

For the polymerizable double bond-containing moiety represented by the general formula (1), specific mention may be made of:

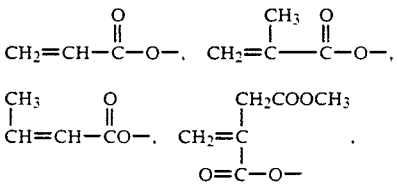

-continued

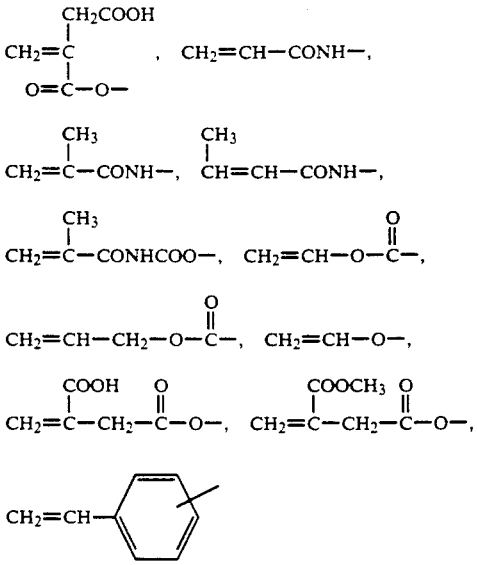

These polymerizable double bond-containing moieties are bonded directly or through any desired connecting group to the main chain of the polymer chain. The connecting group used may specifically be a divalent organic residue consisting of a divalent aliphatic group and/or a divalent aromatic group, which may have in it a connecting group selected from:

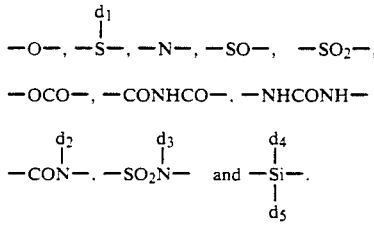

Here $d_1$ to $d_5$ each have the same meanings as defined in connection with $R_1$ in the general formula (1).

For the divalent aliphatic groups, for instance, mention may be made of:

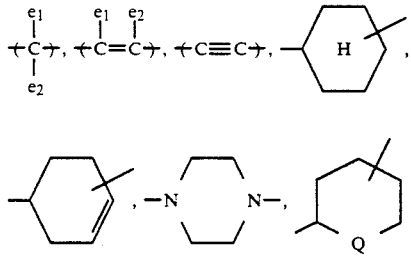

Here $e_1$ and $e_2$ may be identical with or different from each other, and each denote a hydrogen atom, a halogen atom (e.g., a fluorine, chlorine or bromine atom) or a $C_{1-12}$ alkyl group (e.g., a methyl, ethyl, propyl, chloromethyl, bromomethyl, butyl, hexyl, octyl, nonyl or decyl group); Q denotes —O—, —S— or —$NR_{20}$—; and $R_{20}$ indicates an alkyl group having 1–4 carbon atoms, —$CH_2$Cl or —$CH_2$Br.

The divalent aromatic groups, for instance, include a benzene ring group, a naphthalene ring group and a five- or six-membered heterocyclic group (which contains at least one heteroatom selected from oxygen, sulfur and nitrogen atoms as a heteroatom forming the heterocyclic ring). These aromatic groups may have a substituent such as a halogen atom (e.g., a fluorine, chlorine or bromine atom), an alkyl group having 1–8 carbon atoms (e.g., a methyl, ethyl, propyl, butyl, hexyl or octyl group) or an alkoxy group having 1–6 carbon atoms (e.g., a methoxy, ethoxy, propoxy or butoxy group0.

The heterocyclic rings, for instance, include furan, thiophene, pyridine, pyrazine, piperazine, tetrahydrofuran, pyrole, tetrahydropyran and 1,3-oxazoline rings.

Specifically, the polymerizable double bond-containing moiety is bonded randomly to the polymer chair or connected to only one terminal of the main chain of the polymer chain. Preference is given to a polymer in which the polymerizable double bond group-containing moiety is bonded to only one terminal of the main chain of the polymer—this polymer will hereinafter be called simply the monofunctional polymer M.

Specifically but not exclusively, set out below are examples of the polymerizable double bond-containing moiety of the monofunctional polymer M represented by the general formula (1) and the moiety constituted by the organic residue connected thereto. In the ensuing description, however, it is to be noted that $P_1$ denotes —H, —$CH_3$—, —$CH_2COOCH_3$, —Cl, —Br or —CN; X —Cl or —Br, n an integer of 2–12 and m an integer of 1–4.

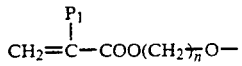
(C-1)

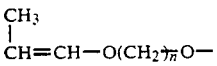
(C-2)

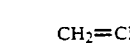
(C-3)

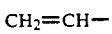
(C-4)

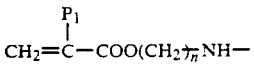
(C-5)

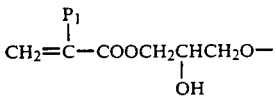
(C-6)

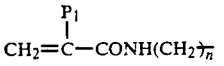
(C-7)

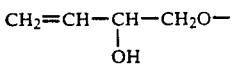
(C-8)

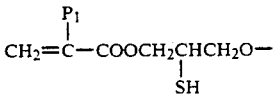
(C-9)

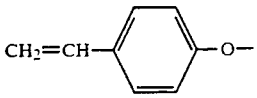
(C-10)

-continued

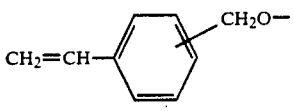
(C-11)

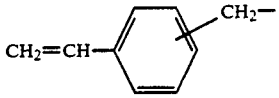
(C-12)

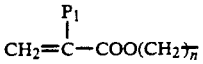
(C-13)

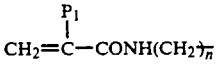
(C-14)

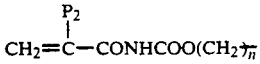
(C-15)

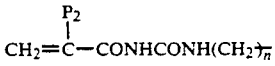
(C-16)

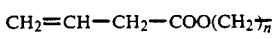
(C-17)

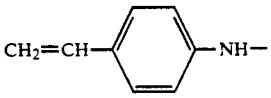
(C-18)

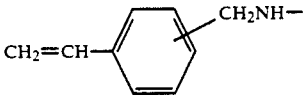
(C-19)

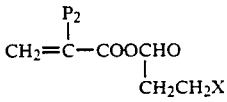
(C-20)

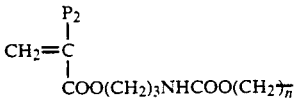
(C-21)

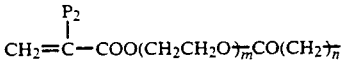
(C-22)

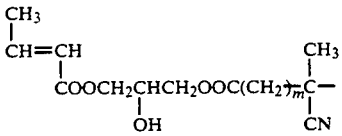

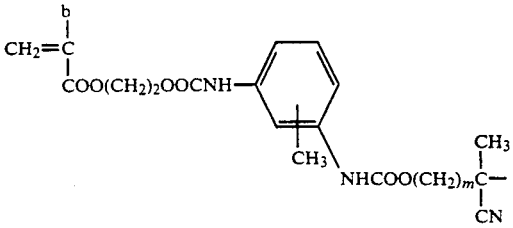
(C-23)

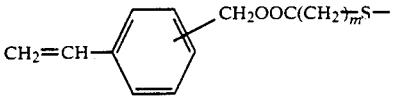
C-24)

-continued (C-25)

$$CH_2{=}CH{-}CH_2{-}OCO(CH_2)_m{-}S{-}$$

(C-26)

$$CH_2{=}CH{-}CH_2COO(CH_2)_m{-}\overset{\overset{CH_3}{|}}{\underset{\underset{CN}{|}}{C}}{-}$$

(C-27)

$$CH_2{=}CH{-}CH_2\underset{\underset{OH}{|}}{C}HCH_2OOC(CH_2)_m{-}\overset{\overset{CH_3}{|}}{\underset{\underset{CN}{|}}{C}}{-}$$

(C-28)

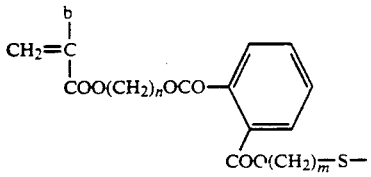

(C-29)

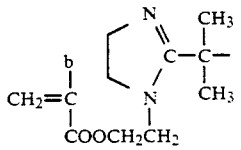

(C-30)

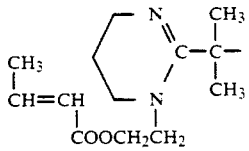

Preferably, the dispersion-stabilizing resin of this invention has a polymerizable double bond moiety in the polymer side chain. It is noted, however, that this polymer may be synthesized in known manners.

Typically, the polymer of this invention may be synthesized by:

(1) the copolymerization of a monomer having in its molecule two polymerizable double bonds which differ in polymerization reactivity, and (2) the so-called polymeric reaction wherein a monofunctional monomer having in its molecule a reactive group such as a carboxyl, hydroxyl, amino or epoxy group is copolymerized to obtain a polymer, which is in turn permitted to react with an organic low-molecular compound having a polymerizable double bond containing other reactive group capable of being chemically bonded to the reactive groups of this polymer.

The above-described procedure (1), for instance, is set forth in Japanese Provisional Patent Publication No. 60-185962.

The above-mentioned procedure (2), for example, is described at great length in:

Yoshio IWAKURA and Keisuke KURITA, "Reactive Polymers" published by Kodansha Ltd. in 1977, Ryohei ODA, "Polymer Fine Chemical" published by Kodansha Ltd. in 1976, Japanese Provisional Patent Publication No. 61-43757, and Japanese Patent Application No. 1-149305 specification.

For instance, the polymeric reactions using combinations of functional groups A with B, as set out in Table 1, are well known as typical procedures. In the ensuing Table 1, $R_{22}$ and $R_{23}$ each denote a hydrocarbon group and have the same meanings as defined in connection with $R_3$-$R_5$ in the $L_1$ of the aforesaid formula (2).

TABLE 1

| Group A | Group B |
|---|---|
| $-COOH$, $-PO_3H_2$, | 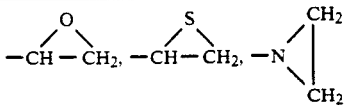 |
| $-OH$, $-SH$, | $-COCl$, $-SO_2Cl$, Cyclic acid anhydride<br>$-N{=}C{=}O$, $-N{=}C{=}S$ |
| $-NH_2$ | 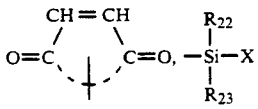 <br>(X is Cl or Br) |
| $-SO_2H$ | |

The monofunctional polymer M containing a polymerizable double bond at one terminal of its main chain, which is a more preferable dispersion-stabilizing resin, may be synthesized by conventional procedures known so far in the art, including:

i) an ionic polymerization procedure wherein various reagents are permitted to react with the terminal of a living polymer obtained by anionic or cationic polymerization, thereby obtaining a monofunctional polymer M, ii) a radical polymerization procedure wherein various reagents are permitted to react with a reactive group-terminated polymer obtained by radical polymerization using a polymerization initiator and/or a chain transfer agent, each having in its molecule a reactive group such as a carboxyl, hydroxyl or amino group, thereby obtaining a monofunctional polymer M, and iii) a polyaddition/polycondensation procedure wherein a polymerizable double bond is introduced into a polymer obtained by polyaddition or polycondensation in the same manner as mentioned with reference to the above-described radical polymerization procedure (ii).

More specifically, the monofunctional polymer M may be synthesized by the procedures set forth in the general remarks of:

P. Dreyfuss & R. P. Quirk, "Encycl. Polym. Sci. Eng.", 7, 551 (1987),

P. F. Rempp & E. Franta, "Adv. Polym. Sci.", 58, 1 (1984),

V. Percec, "Appl. Poly. Sci.", 285, 95(1984),

R. Asami & M. Takari, "Macromol. Chem. Suppl.", 12, 163(1985),

P. Rempp et al, "Macromol. Chem. Suppl.", 8, 3(1984),

Takasi KAWAKAMI, "Chemical Industry", 38, 56(1987),

Yuya YAMASHITA, "Polymer", 31, 988(1982),

Shiro KONISHI, "Polymer", 30, 625(1981),

Nobutoshi HIGASHIMURA, "Nippon Setchaku Kyokai-Shi", 18, 536(1982),

Koichi ITO, "Polymer Processing", 35, 262(1986), and

Takashiro AZUMA and Takasi TSUDA, "Functional Material", 1987, Nos.10 and 5, as well as in literature and patent specifications referred to therein.

More specifically, the monofunctional polymer M containing a recurring unit corresponding to the radically polymerizable monomer may be synthesized by the procedures set forth in Japanese Provisional Patent Publication No. 2-67563 and Japanese Patent Application Nos. 63-64970, 1-206989 and 1-69011 specifications. Also, the monofunctional polymer M containing a polyester or polyether structure as a recurring unit may be synthesized by the procedures set forth in Japanese Patent Application Nos. 1-56379, 1-58989 and 1-56380 specificaitons.

As explained above, the dispersed resin particles of this invention are obtained by the dispersion polymerization of the polar group-containing monofunctional monomer A and the fluorine and/or silicon atom-containing monofunctional monomer B in the presence of the above-described dispersion-stabilizing resin.

In order to allow the dispersed resin particles of this invention to have a high-order network structure, the molecules of a polymer made up of a polymeric component A consisting of the polar group-containing monofunctional monomer A and the fluorine and/or silicon atom-containing monofunctional monomer B are crosslinked together.

In other words, the dispersed resin particles of this invention is a nonaqueous form of latex made up of a portion formed by the polymeric component A and insoluble in a nonaqueous solvent and a polymer portion soluble in said solvent. In the network structure, the molecules of the polymeric component A forming the portion insoluble in said solvent are crosslinked together.

Thus, the network resin particles are made less soluble or insoluble in water. In a more precise term, the solubility of said resin in water is at most 80% by weight, preferably at most 50% by weight.

Crosslinking may be achieved by known crosslinking procedures, i.e., i) crosslinking a polymer containing said polymeric component A with various crosslinking or curing agents, ii) polymerizing a material containing at least a monomer corresponding to said polymeric component A in the presence of a polyfunctional monomer or oligomer containing two or more polymerizable functional groups, thereby crosslinking the molecules together to form a network structure, and (iii) crosslinking said polymeric component A and a polymer including a reactive group-containing component by a polymerization or polymeric reaction.

For the above-described procedure (i), use may be made of compounds usually employed as crosslinking agents. Specifically, such compounds as set forth in "Crosslinker Handbook" edited by Shinzo YAMASHITA and Sosuke KANEKO (published by Taiseisha in 1981) and "Polymer Data Handbook—Basic" edited by the Polymer Society (published by Bifukan in 1986) may be used.

For instance, mention is made of organosilane compounds (e.g., silane coupling agents such as vinyltrimethoxysilane, vinylbutoxysilane, γ-glycidoxypropyltrimethoxysilane, γ-mercaptopropyltriethoxysilane and γ-aminopropyltriethoxysilane), polyisocyanate compounds (e.g., toluylene diisocyanate, o-toluylene diisocyanate, diphenylmethane diisocyanate, triphenylmethane diisocyanate, polymethylenepolyphenyl isocyanate, hexamethylene diisocyanate, isophorone diisocyanate and high-molecular polyisocyanate), polyol compounds (e.g., 1,4-butanediol, polyoxypropylene glycol, polyoxyalkylene glycol and 1,1,1-trimethylolpropane), polyamine compounds (e.g., ethylenediamine, γ-hydropropylated ethylenediamine, phenylenediamine, hexamethylenediamine, N-aminoethylpiperazine and modified aliphatic polyamines), polyepoxy group-containing compounds and epoxy resins—e.g., compounds recited in "New Epoxy Resins" edited and written by Hiroshi KAKIUCHI (published by Shokodo in 1985) and "Epoxy Resins" edited and written by Kuniyuki HASHIMOTO (published by Nikkan Kogyo Shinbunsha in 1969), melamine resins—e.g., compounds recited in "Urea.Melamine Resins" edited and written by Ichiro MIWA and Hideo MATSUNAGA (published by Nikkan Kogyo Shinbunsha in 1969) and poly(meth-)acrylate compounds—e.g., compounds set forth in "Oligomers" edited by Sin OGAWARA, Takeo SAEGUSA and Toshinobu HIGASHIMURA (published by Kodansha in 1976) and "Functional Acrylic Resins" by Eizo OMORI (published by Technosystem in 1985). More specifically, mention is made of polyethylene glycol diacrylate, neopentyl glycol diacrylate, 1,6-hexanediol diacrylate, trimethylolpropane triacrylate, pentaerythritol polyacrylate, bisphenol A-diglycidyl ether diacrylate, oligoester acrylate and their acrylates.

Specifically, two or more functional groups contained in the polyfunctional monomer—which may hereinafter be referred to as the polyfunctional monomer D—or polyfunctional oligomer, which are used for carrying out the above-described procedure (ii), include:

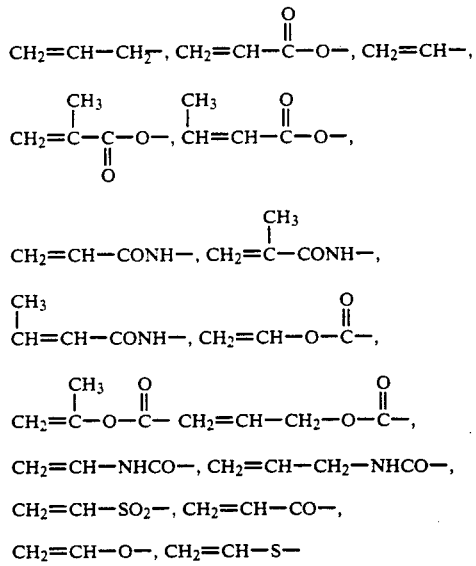

The monomers or oligomers used may have two or more different or identical polymerizable groups, such as those mentioned above.

Specific examples of the monomers having two or more polymerizable functional groups, e.g., monomers or oligomers having identical polymerizable functional groups, are styrene derivaties such as divinylbenzene and trivinylbenzene; methacrylates, acrylates or crotonates, vinyl ethers or allyl ethers of polyvalent alcohols (e.g., ethylene glycol, diethylene glycol, triethylene glycol, polyethylene glycols #200, #400 and #600, 1,3-butylene glycol, neopentyl glycol, dipropylene glycol, polypropylene glycol, trimethylolpropane, trimethylolethane and pentaerythritol) or hydroxyphenols (e.g., hydroquinone, resorcin, catechol and their derivatives); vinyl esters, allyl esters, vinylamides or allylamides of dibasic acids (e.g., malonic, succinic, glutaric, adipic, pimelic, maleic, phthalic and itaconic acids); and condensates of polyamines (e.g., ethylenediamine, 1,3-propylenediamine and 1,4-butylenediamine) and vinyl group-containing carboxylic acids (e.g., methacrylic, acrylic, crotonic and allylacetic acids).

The monomers or oligomers having different polymerizable functional groups, for instance, include reaction products of vinyl group-containing carboxylic acids (e.g., methacrylic acid, acrylic acid, methacryloylacetic acid, acryloylacetic acid, methacryloylpropionic acid, acryloyl-propionic acid, itaconyloylacetic acid, itaconyloylpropionic acid and carboxylic anhydrides) with alcohols or amines (e.g., allyloxycarbonylpropionic acid, allyloxycarbonylacetic acid, 2-allyloxycarbonylbenzoic acid and allylaminocarbonylpropionic acid), vinyl group-containing ester or amide derivatives (e.g., vinyl methacrylate, vinyl acrylate, vinyl itaconate, allyl methacrylate, allyl acrylate, allyl itaconate, methacryloylvinyl acetate, methacryloylvinyl propionate, methacryloylallyl propionate, vinyloxycarbonylmethyl mehacrylate, vinyloxycarbonylmethylxoycarbonylethylene acrylate, N-allylacrylamide, N-allylmethacrylamide, N-allyl intaconic acid amide and methacryloylpropionic acid allylamide), or condensates of amino-alcohols (e.g., amino-ethanol, 1-amino-propanol, 1-amino-butanol, 1-amino-cyanohexanol and 2-amino-butanol) with vinyl group-containing carboxylic acids.

The monomer or oligomer used in this invention and containing two or more polymerizable functional groups is polymerized with the monomer A and other monomers permitted to exist with the monomer A in an amount of at most 10 mol %, preferably at most 5 mol % with respect to the total amount of said monomers to form a resin.

The above-described procedure (iii), in which the reactive groups of the polymeric components are permitted to react with each other to form a chemical bond, whereby they are crosslinked together, may be achieved, as is the case with ordinary reactions of organic low-molecular compounds. More specifically, the same procedures as described in connection with the synthesis of the dispersion-stabilizing resin may be applied.

Because monodisperse particles of a uniform particle size of the order of 0.5 μm or less can be easily obtained by dispersion polymerization and for other reasons, network formation should preferably be achieved by the above-mentioned procedure (ii) using the functional monomer.

As explained above, the network disperse resin particle of this invention is a particulate polymer containing a polymeric component including a polar group-containing recurring unit and a recurring unit including a fluorine and/silicon atom-containing substituent and a polymeric component soluble in a nonaqueous solvent and having a structure in which the molecular chains are highly crosslinked together.

The nonaqueous solvents used for producing a nonaqueous solvent type disperse resin particle may be organic solvents having a boiling point of 200° C. or lower, which may be used alone or in combination of two or more.

Specific, although not exclusive, examples of such organic solvents are alcohols such as methanol, ethanol, propanol, butanol, fluorinated alcohol and benzyl alcohol; ketones such as acetone, methyl ethyl ketone, cyclohexnone and diethyl ketone; ethers such as diethyl ether, tetrahydrofuran and dioxane; carboxylic acid esters such as methyl acetate, ethyl acetate, butyl acetate and methyl propionate; aliphatic hydrocarbons having 6–14 carbon atoms such as hexane, octane, decane, dodecane, tridecane, cyclohexane and cyclooctane; aromatic hydrocarbons such as benzene, toluene, xylene and chlorobenzene; and halogenated hydrocarbons such as methylene chloride, dichloroethane, tetrachloroethane, chloroform, methyl chloroform, dichloropropane and trichloroethane.

When synthesized by dispersion polymerization using a nonaqueous solvent system, the disperse resin particles are easily allowed to have an average particle size of 1 μm or less and a much narrow particle size distribution and are of monodisperse nature.

Specifically, reliance may be placed upon such procedures as set forth in:

K. E. J. Barrett, "Dispersion Polymerization in Organic Media" published by John Wiley (1975), Koichiro MURATA, "Polymer Processing", 23, 20 (1974), Tsunetaka MATSUMOTO and Toyokichi TANGE, "Nippon Setchaku Kyoukai-Shi", 9, 183 (1973), Toyokichi TANGE, "Nippon Setchaku Kyoukai-Shi", 23, 26 (1987), D. J. Walbridge, "NATO. Adv. Study. Inst. Ser. E.", No. 64, 40 (1983), British Patent Nos. 893429 and 934038 specifications, U.S. Pat. Nos. 1122397, 3900412 and 4606989, and Japanese Provisional Patent Publication Nos. 60-179751 and 60-185963.

The disperse resin of this invention comprises at least one monomer A, at least one monomer B and at least one dispersion-stabilizing resin and, if required for network formation, additionally includes the polyfunctional monomer D. In any case, it is important for obtaining the desired disperse resin that the resin synthesized from these monomers be insoluble in a nonaqueous solvent. More specifically, it is desired that the dispersion-stabilizing resin be used in amount lying in the range of 1 to 50%, preferably 2 to 30% by weight, by weight with respect to the monomers A and B to be made insoluble. The resin particle should also have a molecular weight lying in the range of $10^4$ to $10^6$, preferably $10^4$ to $5\times10^5$.

In order to produce the disperse resin particles of this invention, the monomers A and B and, if required, the dispersion-stabilizing resin D are generally polymerized by heating in the presence of a polymerization initiator such as benzoyl peroxide, azobisbutyronitrile or butyllithium in a nonaqueous solvent. Typically but not exclusively, the disperse resin particles of this invention may be produced by:

(i) adding a polymerization initiator to a mixed solvent of the monomers A and B, the dispersion-stabilizing resin and the polyfunctional monomer D, and (ii) adding a mixture of the above-described polymerizable compounds and a polymerization initiator dropwise or in otherwise manners to a nonaqueous solvent.

The total amount of the polymerizable compounds lies in the range of about 5 to 80 parts by weight, preferably 10 to 50 parts by weight per 100 parts by weight of the nonaqueous solvent.

The amount of the polymerization initiator lies in the range of 0.1 to 5% by weight with respect to the total amount of the polymerizable compounds. It is also desired that polymerization take place at a temperature of about 30° to 180° C., preferably 40° to 120° C. for a time of about 1 to 15 hours.

According to this invention as mentioned above, the nonaqueous disperse resin is produced in the form of fine particles having a uniform particle size distribution.

All resins known so far as binder resins may be used for as the matrix resin of the image-receiving layer of this invention. Typical examples are vinyl chloride-vinyl acetate copolymers, styrene-butadiene copolymers, styrene-methacrylate copolymers, methacrylate copolymers, acrylate copolymers, vinyl acetate copolymers, polyvinyl buryal, alkyd resin, silicone resin, epoxy resin, epoxy ester resin and polyester resin. As water-soluble polymer compounds, use may also be made of polyvinyl alcohol, modified polyvinyl alcohol, starch, oxidized starch, carboxymethylcellulose, hydroxyethylcellulose, casein, gelatin, polyacrylates, polyvinyl pyrollidone, polyvinyl ether-maleic anhydride copolymers, polyamides and polyacrylamides.

The matrix resin used for the image-receiving layer of this invention has a molecular weight of preferably $10^3$ to $10^6$, more preferably $5\times10^3$ to $5\times10^5$ and a glass transition temperature of preferably −10° C. to 120° C., more preferably 0° C. to 90° C.

Other consitutent of the image-receiving layer of this invention may be an inorganic pigment, for which kaolin, clay, calcium carbonate, titanium oxide, zinc oxide, barium sulfate and alumina may be used by way example alone.

Although varying in dependence upon the type of material and the particle size of pigment, the binder resin/pigment ratio in the image-receiving layer lies generally in the range of about 1:(0.5-5) by weight, preferably about 1:(0.8-2.5) by weight.

Additinally, the image-receiving layer may contain a crosslinking agent so as to improve film strength. As this crosslinking agent, for instance, use may be made of usually employed ammonium chloride, organic peroxides, metal soap, organosilane, polyurethane curing agents and epoxy resin curing agents. Specifically, use may be made of those set forth in "Crosslinker Handbook" edited by Shinzo YAMASHITA and Tosuke KANEKO (published by Taiseisha in 1981).

For the support used in this invention, for example, use may be made of paper sheets such as wood free paper and wet strength paper sheets, plastic films such as polyester films and metal sheets such as aluminium sheets.

According to this invention, between the support and the image-receiving layer there may be provided an interlayer so as to improve water resistance and interlaminar strength, and on the side of the support opposite to the image-receiving layer there may be provided a back coat layer for the purpose of preventing curling.

The interlayer may be mainly made up of at least one of emulsion type resins such as acrylic resin, ethylene-butadiene copolymers, methacrylic ester-butadiene copolymers, acrylonitrile-butadiene copolymers and ethylene-vinyl acetate copolymers; solvent type resins such as epoxy resin, polyvinyl butyral, polyvinyl chloride and polyvinyl acetate; and such water-soluble resins as mentioned above, and may additionally contain inorganic pigments and waterproofing agents, if required.

The makeup of the back coat layer is substantially similar to that of the interlayer.

When the printing plate precursor of this invention is used for PPC plate-making, electric conductive additives may be further added to the image-receiving layer, the interlayer and/or the back coat layer to allow the printing plate precursor to have a volume resistivity of $10^{10}$ to $10^{13}$ Ωcm, thereby reducing scumming further. The electric conductive additives used may be of either inorganic or organic types. Examples of the inorganic electric conductive additives are those containing salts of monovalent or polyvalent metals such as Na, K, Li, Mg, Zn, Co and Ni, and examples of the organic electric conductive additives are high-molecular cation agents such as polyvinyl benzyl trimethyl ammonium chloride or acrylic resin-modified quaternary ammonium salts or high-molecular agents such as high-molecular sulfonates. The amount of these electric conductive agents added lines in the range of 3 to 40% by weight, preferably 5 to 20% by weight of the amount of the binder used for each layer.

The direct image type lithographic printing plate precursor according to this invention is generally made as follows. If required, an aqueous solution containing the interlayer constituent is first coated and dried onto one side of the support to form the interlayer. Then, an aqueous solution containing the image-receiving layer constituent is coated and dried onto that side to form the image-reciving layer. If required, an aqueous solution containing the back coat layer constituent is further coated and dried onto the other side of the support to form the back coat layer. The amounts of the image-receiving layer, interlayer and back coat layer deposited lie suitably in the respective ranges of 1 to 30 g/m$^2$ and 5 to 20 g/m$^2$.

With the direct image type lithographic printing plate precursor according to this invention, a printing plate is made as follows. First, an image is formed and fixed on this precursor by any one of known techniques for plate-making. Then, the precursor is treated on its surface with a desensitizing solution to desensitize the non-image area. The thus made printing plate may be used for lithography.

For desensitization, it is important that the protected carboxyl group in the resin particle of this invention be laid open by decomposition, which varies depending upon the decomposition reactivity of the protected functional group. By way of example, this decomposition is achieved with hydrolysis with an aqueous solution lying in the acidic pH range of 1-6 or the alkaline pH range of 8-12.

This pH regulation may be easily achieved by known compounds. Alternatively, redox reactions using reducing or oxidizing water-soluble compounds may be used as well. Known to this end are various compounds, for instance, including hydrazine hydrates, sulfites, lipoic acid, hydroquinones, formic acid, thiosulfates, hydrogen peroxide, persulfates and quinones.

The desensitizing solution may additionally contain other compounds so as to improve on its reactivity or storage stability.

For instance, the treating solution may contain an organic solvent soluble in water in an amount of 1 to 50 parts by weight with respect to 100 parts by weight of water. Such organic solvents soluble in water, for instance, may be alcohols (e.g., methanol, ethanol, propanol, propargyl alcohol, benzyl alcohol or phenethyl alcohol), ketones (e.g., acetone, methyl ethyl ketone and acetophenone), ethers (e.g., dioxane, trioxane, tetrahydrofuran, ethylene glycol, propylene glycol, ethylene glycol monomethyl ether, propylene glycol monomethyl ether and tetrahydropyran), amides (e.g., dimethylformamide and dimethylacetamide) and esters (e.g., methyl acetate, ethyl acetate and ethyl formate), which may be used alone or in combination of two or more.

The desensitizing solution may also contain a surface active agent in an amount of 0.1 to 20 parts per 100 parts by weight water. For the surface active agent, use may be made of anioic, cationic or nonionic surfactants known so far in the art. For instance, such compounds as set forth in Hiroshi HORIGUCHI, "New Surface Active Agents" published by Sankyo Shuppan K. K. in 1975 and Rryohei ODA and Kazuhiro TERAMURA, "Synthesis of Surface Active Agents and Their Application" published by Maki Shoten in 1980 may be used.

The scope of this invention, however, is not limited to the above-described examples.

The desensitizing treatment may be carried out at a temperature of 15° C. to 60° C. for a dipping time of 10 seconds to 5 minutes.

When the image-receiving layer contains a protective group which forms a carboxyl group upon decomposition by light, it is irradiated with light after an image has been formed thereon.

For the "chemically active rays" used in this invention, all visible, ultraviolet, far infrared, electron, X, $\gamma$ and $\alpha$ rays may be used. However, preference is given to ultraviolet rays. More preferably, devices giving out rays having a wavelength of 310 nm to 500 nm are used; in general, high-pressure or ultrahigh-pressure mercury lamps are used. Sufficient results are obtained if the image-receiving layer is irradiated with light from a light source usually located 5–50-cm away from it for 10 seconds to 10 minutes.

When the image-receiving layer contains zinc oxide—serving as an inorganic pigment—together with the resin particles according to this invention, it may be further made hydrophilic by the desensitization of zinc oxide according to known manners.

For the desensitization of zinc oxide, use may be made of known desensitizing solutions such as a cyanogen compound-containing solution composed mainly of a ferricyanide and a ferrocyanide, a cyanogen-free solution composed mainly of phytic acid or its derivative and a guanidine derivative, a solution composed mainly of an inorganic or organic acid forming zinc ions and chelates or a solution containing a water-soluble polymer.

Examples of the cyanogen compound-containing desensitizing solutions used, for instance, are set forth in Japanese Patent Publication Nos. 44-9045 and 46-39403 as well as Japanese Provisional Patent Publication Nos. 52-76101, 57-107889 and 54-117201.

Examples of the phytic acid compound-containing solutions used are disclosed in Japanese Patent Publication Nos. 53-83807, 53-83805, 53-102102, 53-109701, 53-127003, 54-2803 and 54-44901.

Examples of the solutions containing metal complex compounds such as a cobalt complex, which are used in this invention, are indicated in Japanese Provisional Patent Publication Nos. 53-104301, 53-140103 and 54-18304 as well as Japanese Patent Publication No. 45-28404.

Examples of the inorganic or organic acid-containing solutions used are set forth in Japanese Patent Publication Nos. 39-13702, 40-10308, 43-28408 and 40-26124 as well as Japanese Provisional Patent Publication No. 51-118501.

Examples of the guanidine compound-containing solutions used are disclosed in Japanese Provisional Patent Publication No. 56-111695.

Examples of the water-soluble polymer-containing solutions used are referred to in Japanese Provisional Patent Publication Nos. 52-126302, 52-134501, 53-49506, 53-59502, 53-104302 and 49-36402 as well as in Japanese Patent Publication Nos. 38-9665, 53-22263, 40-763 and 40-2202.

In all the above-mentioned desensitizing treatments, it is believed that the zinc oxide in the surface layer is ionized into zinc ions, which in turn give rise to a chelating reaction with the cheating compound in the desensitizing solution to form a zinc chelate compound, and this chelate compound is fixed in the surface layer, thereby making it hydrophilic.

Thus, the printing plate produced according to this invention is achieved by the above-mentioned desensitizing treatments.

In the ensuing description, how to prepare the dispersion-stabilizing resin and resin particles according to this invention will be explained.

PREPARATION EXAMPLE 1 OF DISPERSION-STABILIZING RESIN (P-1)

A mixed solution consisting of 100 g of dodecyl methacrylate, 3 g of glycidyl methacrylate and 200 g of toluene was heated to 75° C. under agitation in a nitrogen gas stream. One (1.0) g of 2,2'-azobisisobutyronitrile (AIBN for short) was added to the solution, which was stirred for 4 hours. A further 0.5 g of AIBN was added to the solution for a further 4-hour stirring. Then, 5 g of methacrylic acid, 1.0 g of N,N-dimethyldodecylamine and 0.5 g of t-butylhydroquinone were added to the reaction mixture, which was in turn agitated at a temperature of 110° C. for 8 hours. After cooling, the reaction mixture was re-precipitated in 2 liters of methanol to recover a slightly brownish oily product, followed by drying. The product was obtained in a yield of 73 g and found to have a weight-average molecular weight (Mw) of $3.6\times10^4$.

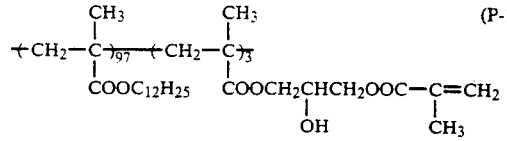

(P-1)

PREPARATION EXAMPLE 2 OF DISPERSION-STABILIZING RESIN (P-2)

A mixed solution of 100 g of 2-ethylhexyl methacrylate, 150 g of toluene and 50 g of isopropanol was heated to 75° C. under agitation in a nitrogen gas stream. Two (2) g of 2,2'-azobis(4-cyanovalerianic acid)—ACV for short—were added to the solution for a 4-hour reaction. A further 0.8 g of ACV was aded to the solution for a further 4 hour-reaction. After cooling, the reaction mixture was re-precipitated in 2 liters of methanol to recover an oily product, which was then dried.

A mixture of 50 g of the obtained oily product, 6 g of 2-hydroxyethyl methacrylate and 150 g of tetrahydrofuran was dissolved to obtain a solution, to which a mixed solution of 8 g of dicyclohexylcarbodiimide (DCC for short), 0.2 g of 4-(N,N-dimethylamino)pyridine and 20 g of methylene chloride was added dropwise at a temperature 25°-30° C. The solution was stirred as such for 4 hours. Then, 5 g of formic acid were added to the reaction mixture, followed by a 1-hour stirring. After the precdipitated insoluble matter had been filtrated out, the filtrate was re-precipitated in 1 liter of methanol to recover an oily product by filtration. Subsequently, this oily product was dissolved in 200 g of tetrahydrofuran and, after filtration of the insoluble matter, was re-precipitated in 1 liter of methanol to collect an oily product, which was finally dried. Yield: 32 g and Mw: $4.2\times10^4$.

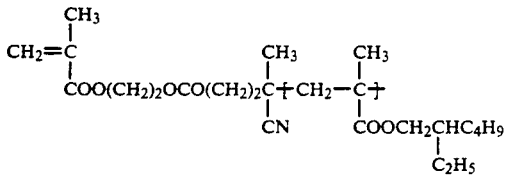

(P-2)

PREPARATION EXAMPLE 3 OF DISPERSION-STABILIZING RESIN (P-3)

A mixed solution of 100 g of butyl methacrylate, 3 g of thioglycolic acid and 200 g of toluene was heated to 70° C. under agitation in a nitrogen gas stream, followed by the addition of 1.0 g of AIBN for an 8-hour reaction. Then, 8 g of glycidyl methacrylate, 1.0 g of N,N-dimethyldodecylamine and 0.5 g of t-butylhydroquinone were added to the reaction solution, which was in turn stirred at a temperature of 100° C. for 12 hours. After cooling, this reaction solution was re-precipitated in 2 liters of methanol to obtain 82 g of an oily product. The polymer was found to have a weight-average molecular weight of $7.6\times10^3$.

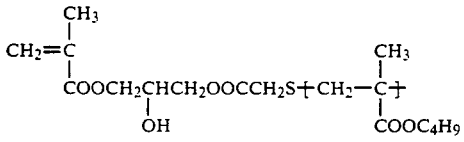

(P-3)

PREPARATION EXAMPLE 4 OF DISPERSION-STABILIZING RESIN (P-4)

A mixed solution of 100 g of n-butyl methacrylate, 2 g of 2-mercaptoethanol and 200 g of tetrahydrofuran was heated to a temperature of 60° C. under agitation in a nitrogen gas stream. One (1.0) g of 2,2-azobis-(isovaleronitrile (AIVN for short) was added to the solution for a 4-hour reaction, and a further 0.5 g of AIVN was added for a further 3-hour reaction, After the reaction product had been cooled down to 25° C., 5 g of methacrylic acid were added thereto, and a mixed solution of 8 g of DCC, 0.2 g of 4-(N,N-dimethylaminopyridine) and 20 g of methylene chloride were added dropwise thereto under agitation over 1 hour.

The reaction product was stirred as such at a temperature of 25°-30° C. for 4 hours, followed by the addition of 10 g of 85% formic acid and a 1-hour stirring.

After the precipitated insoluble matter had been filtrated out, the filtrate was re-precipitated in 1.5 liters of methanol to collect an oily product. Subsequently, this oily product was dissolved in 200 g of tetrahydrofuran. After filtration of the insoluble matter, the product was reprecipiated in 1 liter of methanol to recover an oily product, which was finally dried. Yield: 56 g and Mw: $8\times10^3$.

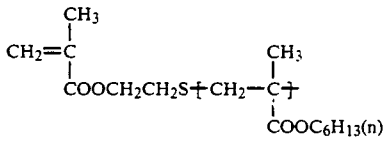

(P-4)

PREPARATION EXAMPLES 5-9 OF DISPERSION-STABILIZING RESINS (P-5 to P-9)

The procedures of Preparation Example 4 were followed with the exception that the compounds set out in Table 2 were used in place of the hexyl methacrylate and acrylic acid, thereby preparing dispersion-stabilizing resins. These resins were found to have an Mw lying in the range of $7\times10^3$ to $8\times10^3$.

TABLE 2

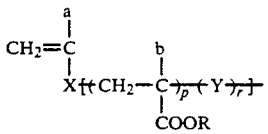

| Prep. Ex. | Resin | a | —X— | b | R | p/r (by weight) | —Y— |
|---|---|---|---|---|---|---|---|
| 5 | P-5 | $-CH_3$ | $-COO(CH_2)_2S-$ | $-CH_3$ | $-C_8H_{17}$ | 85/15 | 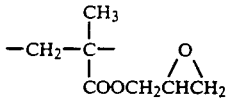 |
| 6 | P-6 | —H | $COO(CH_2)_2OCO(CH_2)_2-$ <br> $-COO(CH_2)_2S-$ | $-CH_3$ | $-C_2H_5$ | 100 | — |
| 7 | P-7 | $-CH_3$ | " | —H | $-C_4H_9$ | 80/20 | 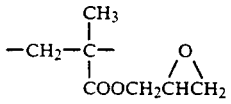 |

TABLE 2-continued

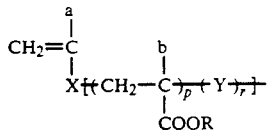

| Prep. Ex. | Resin | a | —X— | b | R | p/r (by weight) | —Y— |
|---|---|---|---|---|---|---|---|
| 8 | P-8 | $-CH_3$ | $-COO(CH_2)_2S-$ | $-CH_3$ | $-C_6H_{13}$ | 90/10 | $-CH_2CH-$ \| $COO(CH_2)_2OCO(CH_2)_2COOH$ |
| 9 | P-9 | " | " | $-CH_3$ | $-C_4H_9$ | 80/20 | 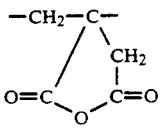 |

PREPARATION EXAMPLE A1 OF RESIN PARTICLES (L-1)

A mixed solution of 10 g of the dispersion-stabilizing resin (P-4) and 200 g of n-octane was heated to a temperature of 60° C. under agitation in a nitrogen gas stream. Added dropwise to this solution over 2 hours was a mixed solution of 47 g of the following monomer A-1, 3 g of the following monomer B-1, 5 g of ethylene glycol dimethyacrylate, 0.5 g of AIVN and 235 g of n-octane, immediately followed by a 2-hour reaction. A further 0.25 g of AIVN was added to the solution for a 2-hour reaction.

After cooling, a white disperse system was obtained through a 200-mesh nylon cloth. (As measured with CAPA-500 made by Horiba Seisakusho K. K.), this system was a latex having an average particle size of 0.18 μm.

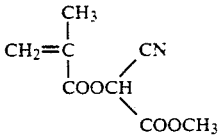

Monomer A-1

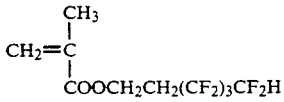

Monomer B-1

PREPARATION EXAMPLES A2A11 OF RESIN PARTICLES (L-2)-(L-11)

The procedures of Preparation Example 1 of Resin Particles were followed with the exception that the monomers referred to in Tables 3 and 4 were used in place of the monomers A-1 and B-1, thereby preparing various forms of resin particles.

The thus obtained resin particles were found to have an average particle size lying in the range of 0.15 to 0.30 μm.

TABLE 3

| Prep. Ex. of resin particles A2 | Resin particles L-2 |
|---|---|

TABLE 3-continued

| | |
|---|---|
| 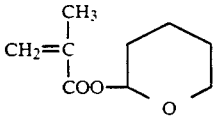 [A-2] | $CH_2=CH$ \| $COO(CH_2)_2(CF_2)_2CF_3$ [B-2] |
| Prep. Ex. of resin particles A3 | Resin particles L-3 |
| 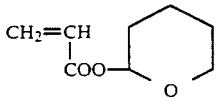 [A-3] | [B-2] |
| Prep. Ex. of resin particles A4 | Resin particles L-4 |
| 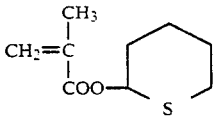 [A-4] | $CH_3$ \| $CH_2=C$ \| $COO(CH_2)_2(CF_2)_nCF_2H$ n: 8 ~ 10 [B-3] |
| Prep. Ex. of resin particles A5 | Resin particles L-5 |
| $CH_2=CH$ \| $COOSi(C_3H_7)_3$ [A-5] | $CH_2=CH$ \| $COOCH_2(CF_2)_2CF_2H$ [B-4] |
| Prep. Ex. of resin particles A6 | Resin particles L-6 |
| $CH_2=CH$ \| $CO-N$ 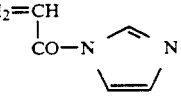 [A-6] | $CH_2=CH$ \| $CONH(CH_2)_2(CF_2)_4CF_3$ [B-5] |
| Prep. Ex. of resin particles A7 | Resin particles L-7 |
| $CH_2=CH$ \| $COOCH$ ($COCH_3$, $COOCH_3$) [A-7] | $CH_2=CH$ \| $CONHCH_2CF_2CFHCF_3$ [B-6] |

TABLE 4

| Prep. Ex. of resin particles A8 | Resin particles L-8 |
|---|---|

TABLE 4-continued

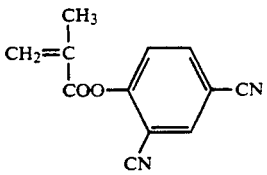

[A-8]

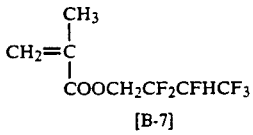

[B-7]

Prep. Ex. of resin particles A9 Resin particles L-9

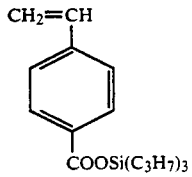

[A-9]

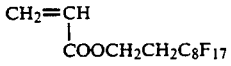

[B-8]

Prep. Ex. of resin particles B10 Resin particles L-10

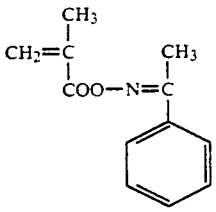

[A-10]

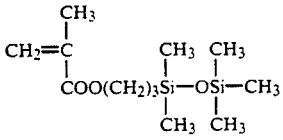

[B-9]

Prep. Ex. of resin particles B11 Resin particles L-11

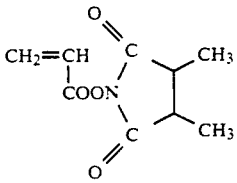

[A-11]

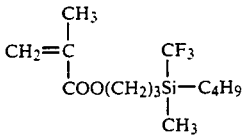

[B-10]

PREPARATION EXAMPLE A12 OF RESIN PARTICLES (L-12)

A mixed solution of 7.5 g of a dispersion-stabilizing resin AA-6 (a macromonomer made by Toa Gosei Kagaku K. K., i.e., a macromonomer consisting of methyl methacrylate recurring units and having an Mw of $1.5\times10^4$) and 133 g of methyl ethyl ketone was heated to 60° C. under agitation in a nitrogen gas stream. Added dropwise to this solution over 1 hour was a mixed solution of 45 g of the following monomer A-12, 5 g of the following monomer B-11, 5 g of diethylene glycol dimethacrylate, 0.5 g of AIVN and 150 g of methyl ethyl ketone, followed by the addition of a further 0.25 g of AIVN for a 2-hour reaction.

The disperse system obtained through a 200-mesh nylon cloth after cooling was found to have an average particle size of 0.25 μm.

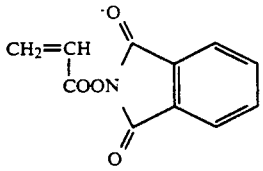

Monomer A-12

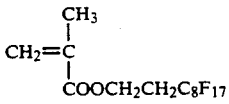

Monomer B-11

PREPARATION EXAMPLE A13 OF RESIN PARTICLES (L-13)

A mixed solution of 7.5 g of the dispersion-stabilizing resin P-5 and 200 g of methyl ethyl ketone was heated to 60° C. under agitation in a nitrogen gas stream. Added dropwise to this solution over 2 hours was a mixed solution of 22 g of monomer A-12, 3 g of monomer B-7, 15 g of acrylamide, 0.5 g of AIVN and 240 g of methyl ethyl ketone, immediately followed by a 2-hour reaction. The disperse system obtained through a 200-mesh nylon cloth after cooling was found to have an average particle size of 0.28 μm.

PREPARATION EXAMPLE A14 OF RESIN PARTICLES (L-14)

Added dropwise to a solution of 300 g of n-octane heated to a temperature of 60° C. under agitation in a nitrogen gas stream over 2 hours were 47.5 g of monomer A-1, 2.5 g of monomer B-7, 3 g of ethylene glycol diacrylate, 8.0 g of the dispersionstabilizing resin P-7 and 150 g of ethyl acetate.

After the reaction system was allowed to react as such for 1 hour, a further 0.3 g of AIVN was added thereto for a further 2 hours. The disperse system obtained through a 200-mesh nylon cloth after cooling was found to have an average particle size of 0.25 μm.

PREPARATION EXAMPLES A15–A25 OF RESIN PARTICLES (L-15)-(L-25)

The procedures of Preparation Example 14 of Resin Particles were followed with the exception that 5 g of the polyfunctional compounds referred to in Table 5 were used in place of 3 g of ethylene glycol diacrylate, thereby preparing resin particles (L-15)-(L-25). The obtained resin particles had all a polymerization degree of 95 to 98% and an average particle size of 0.15 to 0.25 μm.

TABLE 5

| Ex. Nos. of Resin Particles | Resin Particles (L) | Polyfunctional Compounds |
|---|---|---|
| A15 | L-15 | Ethylene glycol dimethacrylate |
| A16 | L-16 | Divinylbenzene |
| A17 | L-17 | Diethylene glycol dimethacrylate |
| A18 | L-18 | Trivinylbenzene |
| A19 | L-19 | Ethylene glycol diacrylate |
| A20 | L-20 | Propylene glycol dimethacrylate |
| A21 | L-21 | Propylene glycol diacrylate |
| A22 | L-22 | Vinyl methacrylate |
| A23 | L-23 | Allyl methacrylate |
| A24 | L-24 | Trimethylolpropane trimethacrylate |
| A25 | L-25 | Isopropenyl Itaconate |

PREPARATION EXAMPLES A26–A31 OF RESIN PARTICLES (L-26)–(L-31)

The procedures of Preparation Example 12 of Resin Particles were followed with the exception that the dispersion-stabilizing resins indicated in Table 6 were used in place of the dispersion-stabilizing resin AA-6, thereby preparing various resin particles.

The obtained resin particles were found to have an average particle size lying in the range of 0.20 to 0.25 μm.

TABLE 6

| E | RP | DSR | E | RP | DSR |
|---|---|---|---|---|---|
| A26 | L-26 | P-5 | A29 | L-29 | P-9 |
| A27 | L-27 | P-7 | A30 | L-30 | P-4 |
| A28 | L-28 | P-8 | A31 | L-31 | P-2 |

Note:
E - Preparation Example of Resin Particles
RP - Resin Particles
DSR - Dispersion Stabilizing Resin

PREPARATION EXAMPLES A32–A35 OF RESIN PARTICLES (L-32)–(L-35)

The procedures of Preparation Example 13 of Resin Particles were followed with the exception that the compounds indicated in Table 7 were used in place of the monomer A-12, acrylamide and reaction solvent methyl ethyl ketone, thereby preparing resin particles.

The obtained resin particles were found to have an average particle size lying in the range of 0.15 to 0.30 μm.

TABLE 7

| Prep. Ex. of resin partiles | Resin particles | Monomer [A] | Other monomers | Reaction solvent |
|---|---|---|---|---|
| A32 | L-32 | 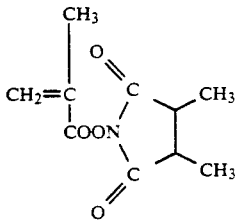 [A-13] | Acrylonitrile | Methyl ethyl keton |
| A33 | L-33 | 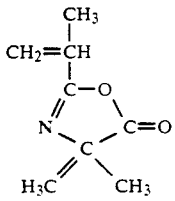 [A-14] | Not used | Ethyl acetate:n-Hexane (at 1:7 weight ratio) |
| A34 | L-34 | 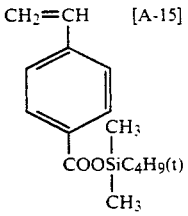 [A-15] | Styrene | n-Octane |
| A35 | L-35 | 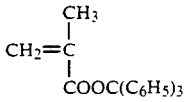 [A-16] | Methyl methacrylate | n-Octane |

PREPARATION EXAMPLE B1 OF RESIN PARTICLES (M-1)

A mixed solution of 10 g of the dispersion-stabilizing resin P-4 and 200 g of dipropyl ketone was heated to a temperature of 60° C. under agitation in a nitrogen gas stream. Added dropwise to this solution over 2 hours was a mixed solution of 47 g of the following monomer D-1, 3 g of the following monomer B-1, 2 g of ethylene glycol dimethacrylate, 0.5 g of AIVN and 235 g of dipropyl ketone, immediately followed by a 2-hour reaction. A further 0.3 g of AIVN was added to the solution for a further 2-hour reaction.

The white disperse system obtained through a 200-mesh nylon cloth after cooling was a latex having an average particle size of 0.18 μm, (as measured by CAPA-500 made by Horiba Seisakusho K. K.).

Monomer D-1

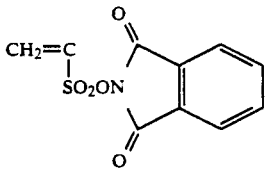

Monomer B-1

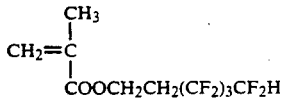

PREPARATION EXAMPLES B2-B11 OF RESIN PARTICLES (M-2)-(M-11)

The procedures of Preparation Example B1 of Resin Particles were followed with the exception that the monomers referred to in Tables 8 and 9 were used in place of monomers D-1 and B-1, thereby preparing resin particles. The obtained resin particles were found to have an average particle size lying in the range of 0.15 to 0.30 μm.

TABLE 8

Prep. Ex. of resin particles B2

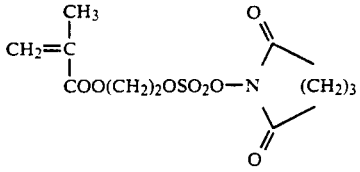

[D-2]

Resin particles M-2

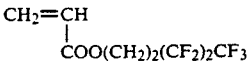

[B-2]

Prep. Ex. of resin particles B3

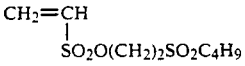

[D-3]

Resin particles M-3

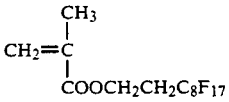

[B-11]

Prep. Ex. of resin particles B4

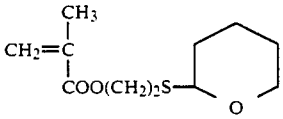

[D-4]

Resin particles M-4

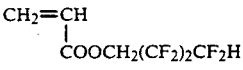

[B-4]

Prep. Ex. of resin particles B5

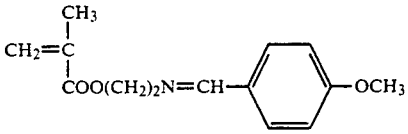

[D-5]

Resin particles M-5

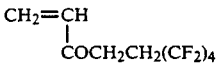

[B-12]

Prep. Ex. of resin particles B6

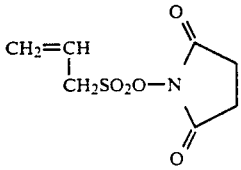

[D-6]

Resin particles M-6

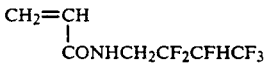

[B-6]

Prep. Ex. of resin particles B7

Resin particles M-7

TABLE 8-continued

| | |
|---|---|
| 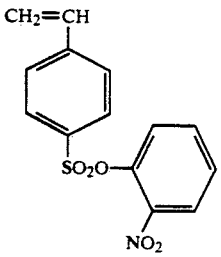 [D-7] | 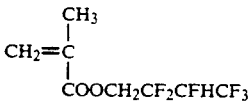 [B-7] |

TABLE 9

| | |
|---|---|
| Prep. Ex. of resin particles B8 | Resin particles M-8 |
| 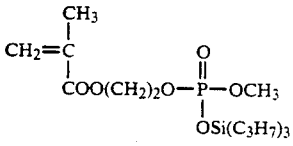 [D-8] | 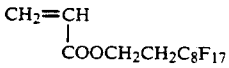 [B-8] |
| Prep. Ex. of resin particles B9 | Resin particles M-9 |
| 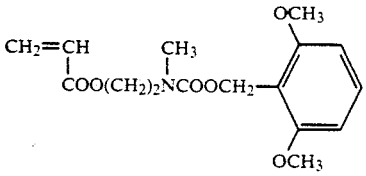 [D-9] | 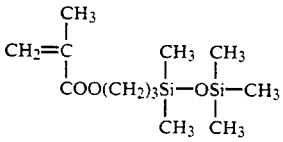 [B-9] |
| Prep. Ex. of resin particles B10 | Resin particles M-10 |
| 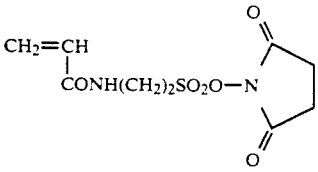 [D-10] | 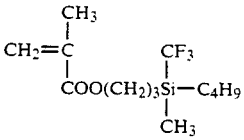 [B-10] |
| Prep. Ex. of resin particles B11 | Resin particles M-11 |
| 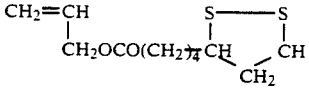 [D-11] | 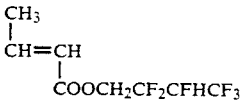 [B-13] |

PREPARATION EXAMPLE B12 OF RESIN PARTICLES (M-12)

A mixed solution of 7.5 g of a dispersion-stabilizing resin AA-6 (a macromonomer made by Toa Gosei Kagaku K. K., i.e., a macromonomer consisting of methyl methacrylate recurring units and having an Mw of $1.5\times10^4$) and 133 g of methyl ethyl ketone was heated to 60° C. under agitation in a nitrogen gas stream. Added dropwise to this solution over 1 hour was a mixed solution of 50 g of the following monomer D-12, 5 g of the following monomer B-14, 5 g of diethylene glycol dimethacrylate, 0.5 g of AIVN and 150 g of methyl ethyl ketone, followed by the addition of a further 0.25 g of AIVN for a 2-hour reaction.

The disperse system obtained through a 200-mesh nylon cloth after cooling was found to have an average particle size of 0.25 μm.

Monomer D-12

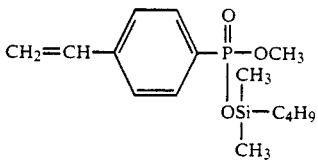

-continued

Monomer B-14

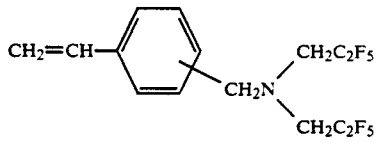

PREPARATION EXAMPLE B13 OF RESIN PARTICLES (M-13)

A mixed solution of 7.5 g of the dispersion-stabilizing resin P-5 and 235 g of methyl ethyl ketone was heated to 60° C. under agitation in a nitrogen gas stream. Added dropwise to this solution over 2 hours was a mixed solution of 22 g of a monomer D-13 having the following structure, 3 g of monomer B-7, 15 g of acrylamide, 0.5 g of AIVN and 200 g of methyl ethyl ketone, immediately followed by a 1-hour reaction.

A further 0.25 g of AIVN was added to the solution for a further 2-hour reaction. The disperse system obtained through a 200-mesh nylon cloth after cooling was found to have an average particle size of 0.28 μm.

Monomer D-13

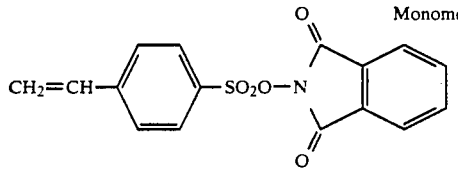

PREPARATION EXAMPLE B14 OF RESIN PARTICLES (M-14)

A mixed solution of 40 g of a monomer D-14 having the following structure, 4 g of monomer B-2, 2 g of ethylene glycol diacrylate, 10 of the dispersion-stabilizing resin P-7 and 235 g of methyl ethyl ketone was heated to a temperature of 60° C. in a nitrogen gas stream. The solution was added dropwise to a solution of 200 g of methyl ethyl ketone under agitation over 2 hours. After the reaction system had been permitted to react as such for 1 hour, 0.3 g of AIVN were further added to the reaction system for a further 2-hour reaction. The disperse system obtained through a 200-mesh nylon cloth after cooling was found to have an average particle size of 0.20 μm.

Monomer D-14

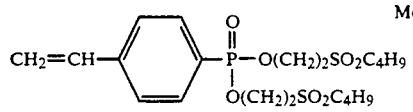

PREPARATION EXAMPLES B15-B25 OF RESIN PARTICLES (M-15)-(M-25)

The procedures of Preparation Example 14 of Resin Particles were followed with the exception that the polyfunctional compounds indicated in Table 10 were used in place of 2 g of ethylene glycol diacrylate, thereby preparing resin particles M-15 to M-25.

The obtained resin particles had all a polymerization degree of 95-98% and an average particle size lying in the range of 0.15 to 0.25 μm.

TABLE 10

| Ex. Nos. of Resin Particles | Resin Particles (M) | Polyfunctional Compounds |
|---|---|---|
| B15 | M-15 | Ethylene glycol dimethacrylate |
| B16 | M-16 | Divinylbenzene |
| B17 | M-17 | Diethylene glycol dimethacrylate |
| B18 | M-18 | Trivinylbenzene |
| B19 | M-19 | Ethylene glycol diacrylate |
| B20 | M-20 | Propylene glycol dimethacrylate |
| B21 | M-21 | Propylene glycol diacrylate |
| B22 | M-22 | Vinyl methacrylate |
| B23 | M-23 | Allyl methacrylate |
| B24 | M-24 | Trimethylolpropane trimethacrylate |
| B25 | M-25 | Isopropenyl Itaconate |

PREPARATION EXAMPLES B26-B31 OF RESIN PARTICLES (M-26)-(M-31)

The procedures of Preparation Example B12 of Resin Particles were followed with the exception that the dispersion-stabilizing resins indicated in Table 11 were used in place of the dispersion-stabilizing resin AA-6, thereby preparing various resin particles.

The obtained resin particles were found to have an average particle size lying in the range of 0.20 to 0.25 μm.

TABLE 11

| E | RP | DSR | E | RP | DSR |
|---|---|---|---|---|---|
| B26 | M-26 | P-4 | B29 | M-29 | P-7 |
| B27 | M-27 | P-5 | B30 | M-30 | P-8 |
| B28 | M-28 | P-6 | B31 | M-31 | P-9 |

Note:
E - Preparation Example of Resin Particles
RP - Resin Particles
DSR - Dispersion-Stabilizing Resin

PREPARATION EXAMPLES B32-B35 of RESIN PARTICLES (M-32)-(M-35)

The procedures of Preparation Example B13 of Resin Particles were followed with the exception that the compounds indicated in Table 12 were used in place of the monomer D-13, acrylamide and reaction solvent methyl ethyl ketone, thereby preparing resin particles.

The obtained resin particles were found to have an average particle size lying in the range of 0.15 to 0.30 μm.

TABLE 12

| Prep. Ex. of resin Particles | Resin particles | Monomer (D) and other monomer | Reaction Solvent |
|---|---|---|---|
| B32 | M-32 | [D - 1]<br>Acrylonitrile | Methyl ethyl keton |

TABLE 12-continued

| Prep. Ex. of resin Particles | Resin particles | Monomer (D) and other monomer | Reaction Solvent |
|---|---|---|---|
| B33 | M-33 | 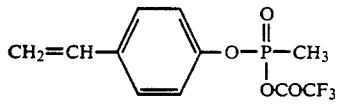 [D-15] | Ethyl acetate:n-Hexane (at 1:7 weight ratio) |
| | | Other monomer was not used. | |
| B34 | M-34 | 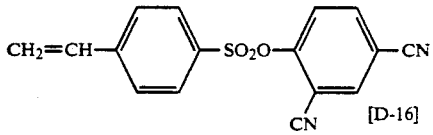 [D-16] | n-Octane |
| | | Styrene | |
| B35 | M-35 | 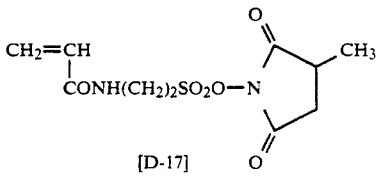 [D-17] | Ethyl acetate:n-Octane (at 1:4 weight ratio) |
| | | Methyl methacrylate | |

EXAMPLE 1

A mixture of 1.8 g of the resin particles L-12, 18 g of a binder resin C-1 having the following structure, 100 g of zinc oxide and 150 g of toluene was dispersed in a homogenizer (made by Nippon Seiki K. K.) at $6\times10^3$ rpm for 10 minutes. The dispersion, to which 0.2 g of phthalic anhydride and 0.01 g of phenol were added, was further dispersed at $1\times10^3$ rpm for 1 minute.

With the use of a wire bar, this disperse system was coated on an interlayer of a support—which was made up of wood free paper provided with a back coat layer on one side and with the interlayer on the other side—at a dry coverage of 18 g/m$^2$, then dried at 100° C. for 30 seconds and finally heated at 120° C. for 1 hour.

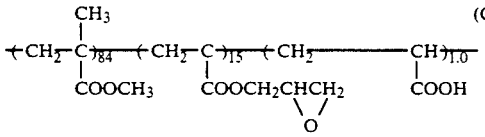

(C-1)

Mw: $4.5\times10^4$ (by weight)

This printing plate precursor obtained with a commercially available PPC was passed once through an etching machine with a desensitizing solution ELP-EX (made by Fuji Photo Film Co., Ltd.), then immersed in an aqueous monoethanolamine solution—F-1—at a concentration of 0.5 mol % per liter and finally washed with water.

Then, printing was made on wood free paper with this printing plate set in an offset press (Oliver 52 made by Sakurai Seisakusho K. K.) using as dampening water a solution obtained by diluting the desensitizing solution F-1 20 times with water. Even after as many as 3000 prints had been obtained, no problem arose in connection with non-image area's scumming and image quality.

EXAMPLE 2

Three (3) g of the resin particles L-10, 30 g of a resin C-2 having the following structure, 80 g of zinc oxide and 10 g of colloidal silica were dispersed together in a homogenizer (made by Nippon Seiki K. K.) at $6\times10^3$ rpm for 10 minutes.

This disperse system, to which 0.01 g of 3,3',4,4'-benzophenonetetracarboxylic dianhydride and 0.005 g of o-chlorophenol were added, was further dispersed at $1\times10^3$ rpm for 1 minute. With the use of a wire bar, the obtained disperse system was coated on an interlayer of a support—which was made up of wood free paper provided with a back coat layer on one side and with the interlayer on the other side—at a dry coverage of 18 g/m$^2$, then dried at 100° C. for 60 seconds and finally heated at 120° C. for 1 hour, thereby preparing a lithographic printing plate precursor.

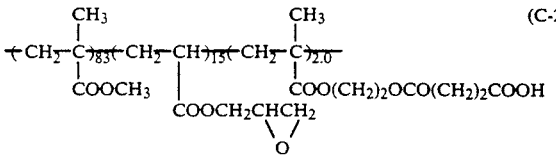

(C-2)

Mw: $5.6\times10^4$ (by weight)

After a printing plate had been made using this plate precursor, it was kept stationary 10-cm away from a 300-w high-pressure mercury lamp for 3 minutes, and then passed once through an etching machine using an aqueous solution obtained by diluting ELP-EX (made by Fuji Photo Film Co., Ltd.) twice with water. As in Example 1, printing was made with the printing plate set in the same offset press using as dampening water a solution obtained by diluting ELP-EX 20 times with water. As many as nonfogging 3000 prints of high image quality could be obtained.

EXAMPLE 3

A mixture of 1 g of the resin particles L-26, 2 g of a resin C-3 having the following structure, 80 g of zinc oxide, 10 g of titanium oxide and 200 g of toluene was dispersed in a homogenizer at $6\times10^3$ rpm for 10 minutes. The disperse system, to which 0.05 g of maleic anhydride were added, was further dispersed at $1\times10^3$ rpm for 1 minute.

The thus obtained disperse system was coated on a support under the same conditions as in Ex. 1, then dried at 100° C. for 30 seconds and finally heated at 120° C. for 1 hour to make a lithographic printing plate precursor.

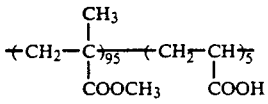

(C-3)

Mw: $7\times10^3$ (by weight)

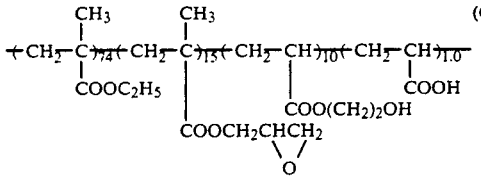

(C-4)

Mw: $4.5\times10^4$ (by weight)

After a printing plate had been made with this plate precursor as in Ex. 1, it was passed once through an etching machine using ELP-EX and then dipped in the following treating solution for 3 minutes.

Treating Solution: F-2

This solution was obtained by dissolving 80 g of diethanolamine, 6 g of Newmar B4SN (made by Nippon Nyukazai K. K.) and 100 g of methyl ethyl ketone in 1 liter of distilled water and regulated to pH 10.5 with potassium hydroxide.

With this printing plate, printing was made using as dampening water a solution obtained by diluting F-2 20 times with water. Up to 3000 prints bearing clearcut images with no scumming could be obtained.

EXAMPLES 4–19

The procedures of Ex. 1 were followed with the exception that the copolymers referred to in Table 13 were used in place of the resin particles L-26 of Ex. 3, thereby making various lithographic printing plate precursors.

TABLE 13

| Ex. No. | Dispersed Resin Particles L | Ex. No. | Dispersed Resin Particles L |
|---|---|---|---|
| 4 | L-1 | 12 | L-9 |
| 5 | L-2 | 13 | L-11 |
| 6 | L-3 | 14 | L-12 |
| 7 | L-4 | 15 | L-13 |
| 8 | L-5 | 16 | L-14 |
| 9 | L-5 | 17 | L-27 |
| 10 | L-7 | 18 | L-28 |
| 11 | L-8 | 19 | L-29 |

Printing plates constructed from these plate precursors were each passed once through an etching machine using ELP-FX and then dipped in the following treating solution E-3 for 3 minutes.

Treating Solution: F-3

This solution was obtained by dissolving 100 g of boric acid, 8 g of Neosoap (made by Matsumoto Yushi K. K.) and 80 g of benzyl alcohol in 1 liter of distilled water and regulated to pH 11.0 with potassium hydroxide.

With each printing plate, printing was made using as dampening water a solution obtained by diluting F-3 20 times with water. About 3000 prints bearing nonfogging and clearcut images could be obtained.

EXAMPLES 20–24

Lithographic printing plate precursors were made by following the procedures of Ex. 1 with the exception that the compounds set out in Table 14 were used in place of the resin particles L-26 and maleic anhydride used in Ex. 3.

TABLE 14

| Ex. | Resin Particles | Crosslinker of the Invention |
|---|---|---|
| 20 | L-30 | Ethylene glycol diglycidyl ether |
| 21 | L-19 | Eponit 012 (Nitto Kasei K. K.) |
| 22 | L-21 | Rikaresin PO-24 (Sin-Nippon Rika) |
| 23 | L-27 | Diphenylmethane diisocyanate |
| 24 | L-28 | Triphenylmethane triisocynate |

Printing was made using a printing plate constructed from each precursor and desensitized as in Ex. 1. As a result, it was found that even after printing was repeated 3000 times, there could be obtained a print bearing a nonfogging and clearcut image.

EXAMPLE 25

A lithographic printing plate precursor was made by following the procedures of Ex. 1 with the exception that the resin particles M-1 were used in place of the resin particles L-1.

Then, this printing plate precursor was formed into a printing plate and desensitized as in Ex. 1. Printing was made on wood free paper with this printing plate set in an offset press (Oliver 52 made by Sakurai Seisakusho K. K.). Even after printing was repeated 3000 times, no problem was found at all in connection with non-image area's scumming and image quality.

EXAMPLE 26

A lithographic printing plate precursor was made by following the procedures of Ex. 2 with the exception that the resin particles M-10 were used in place of the resin particles L-10.

Then, this printing plate precursor was treated as in Ex. 2. As a result, it was found that as many as 3000 nonfogging and clearcut prints could be obtained.

EXAMPLE 27

A lithographic printing plate precursor was made by following the procedures of Ex. 3 with the exception that the resin particles M-26 were used in place of the resin particles L-26.

Then, this printing plate precursor was treated as in Ex. 3. As a result, it was found that as many as 3000 nonfogging and clearcut prints could be obtained.

EXAMPLES 28–43

Various lithographic printing plate precursors were made by following the procedures of Ex. 1 with the exception that the copolymers set out in Table 15 were used in place of the resin particles M-26 used in Ex. 27.

TABLE 15

| Ex. No. | Dispersed Resin Particles M | Ex. No. | Dispersed Resin Particles M |
|---|---|---|---|
| 28 | M-1 | 37 | M-9 |
| 29 | M-2 | 37 | M-11 |
| 30 | M-3 | 38 | M-12 |
| 31 | M-4 | 39 | M-13 |
| 32 | M-5 | 40 | M-14 |
| 33 | M-5 | 41 | M-27 |
| 34 | M-7 | 42 | M-28 |
| 35 | M-8 | 43 | M-29 |

Lithographic printing plates were made by treating these precursors as in Examples 4–19.

With each printing plate, printing was made using as dampening water a solution obtained by diluting F-3 20 times with water. As a result, it was found that even after printing was repeated 3000 times, a nonfogging and clearcut print could be obtained.

EXAMPLES 44–48

Lithographic printing plate precursors were made by following the procedures of Ex. 1 with the exception that the compounds set out in Table 16 were used in place of the resin particles M-26 of Ex. 27.

TABLE 16

| Ex. | Resin Particles | Crosslinker of the Invention |
|---|---|---|
| 44 | M-30 | Ethylene glycol diglycidyl ether |
| 45 | M-19 | Eponit 012 (Nitto Kasei K. K.) |
| 46 | M-21 | Rikaresin PO-24 (Sin-Nippon Rika) |
| 47 | M-27 | Diphenylmethane diisocyanate |
| 48 | M-28 | Triphenylmethane triisocynate |

Each precursor was formed into a printing plate and desensitized as in Ex. 27 for printing. As a result, it was found that even after printing was repeated 3000 times, a nonfogging and clearcut print could be obtained.

What we claim is:

1. A direct image lithographic printing plate precursor having an image-receiving layer on a support, wherein said image-receiving layer contains at least one of dispersed resin particles which are copolymer resin particles obtained by dispersion polymerization of a monofunctional monomer A and a monofunctional monomer B in an organic solvent having a boiling point of 200° C. or lower in the presence of a dispersion-stabilizing resin soluble in said organic solvent, said monofunctional monomer A containing at least one functional group which forms at least one hydrophilic group selected from the group consisting of a carboxyl group, a thiol group, a phosphono group, an amino group and a sulfo group upon decomposition by desensitization, said monomer being soluble in said organic solvent but made insoluble therein upon polymerization, and said monofunctional monomer B containing at least one of a silicon and a fluorine atom-containing substituent and being copolymerizable with said monofunctional monomer A.

2. A direct image lithographic printing plate precursor as claimed in claim 1, wherein said dispersed resin particles have a high-order network structure.

3. A direct image lithographic printing plate precursor as claimed in claim 1, wherein said dispersion-stabilizing resin has in its polymer chain at least one polymerizable double bond moiety represented by the following general formula (1):

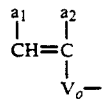

(1)

where:

$V_0$ represents —O—, —COO—, —OCO—,

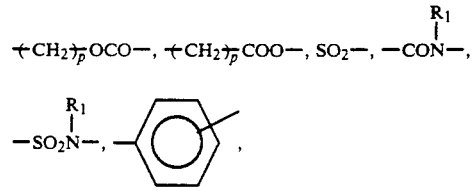

—CONHCOO— or —CONHCONH— (wherein p represents an integer of 1–4 and $R_1$ represents a hydrogen atom or a hydrocarbon group having 1–18 carbon atoms), and $a_1$ and $a_2$, which are the same or different, each represents a hydrogen atom or a halogen atom, a cyano group, a hydrocarbon group or —COO—$R_2$ or —COO—$R_2$ through a hydrocarbon group (wherein $R_2$ represents a hydrogen atom or a hydrocarbon group).

4. A direct image lithographic printing plate precursor as claimed in claim 1, wherein the organic solvent is selected from the group consisting of an alcohol, a ketone, an ether, a carboxylic acid ester, an aliphatic hydrocarbon having from 6–14 carbon atoms, an aromatic hydrocarbon and a halogenated hydrocarbon.

5. A direct image lithographic printing plate precursor as claimed in claim 1, wherein the dispersed resin particles comprise repeating units derived from monomer A in an amount of at least 30% by weight and repeating units derived from monomer B in an amount of from 0.5 to 30% by weight.

6. A direct image lithographic printing plate precursor as claimed in claim 1, wherein the dispersion-stabilizing resin has a weight-average molecular weight within the range of from $1\times10^3$ to $5\times10^5$.

7. A direct image lithographic printing plate precursor as claimed in claim 1, wherein the dispersed resin particles have an average particle size of 1 μm or less.

8. A direct image lithographic printing plate precursor as claimed in claim 1, wherein the dispersed resin particles have an average particle size of from 0.15 to 0.30 μm.

9. A direct image lithographic printing plate precursor as claimed in claim 1, wherein the dispersion-stabilizing resin is contained in a reaction medium used to copolymerize monomer A and monomer B in an amount of from 1 to 50% by weight, with respect to the weight of the monomers A and B introduced into the reaction medium.

10. A direct image lithographic printing plate precursor as claimed in claim 1, wherein the dispersed resin particles have a molecular weight of from $10^4$ to $10^6$.

11. A direct image lithographic printing plate precursor as claimed in claim 1, wherein monomer A and monomer B are contained in a reaction medium used to copolymerize the same in an amount of from 5 to 80 parts by weight per 100 parts by weight of the organic solvent.

* * * * *